US005320160A

United States Patent [19]

Kato et al.

[11] Patent Number: 5,320,160

[45] Date of Patent: Jun. 14, 1994

[54] CASTING DEVICE, METHOD FOR USING THE DEVICE, CASTING DEVICE OF VEHICLE WHEEL, METHOD FOR USING THE DEVICE, AND VEHICLE WHEEL

[75] Inventors: Takashi Kato; Masami Yamamoto; Masaru Kurebayashi; Masaaki Uruma; Hisao Totsuka, all of Shizuoka, Japan

[73] Assignee: Asahi Katantetsu Kabushiki Kaisha, Shizuoka, Japan

[21] Appl. No.: 840,645

[22] Filed: Feb. 21, 1992

Related U.S. Application Data

[63] Continuation of Ser. No. 388,322, Jul. 31, 1989, abandoned.

[30] Foreign Application Priority Data

| | | | |
|---|---|---|---|
| Jul. 31, 1988 | [JP] | Japan | 63-191445 |
| Jul. 31, 1988 | [JP] | Japan | 63-191446 |
| Jul. 31, 1988 | [JP] | Japan | 63-191447 |
| Jul. 31, 1988 | [JP] | Japan | 63-191448 |
| Jul. 31, 1988 | [JP] | Japan | 63-191453 |
| Jul. 31, 1988 | [JP] | Japan | 63-191454 |
| Nov. 29, 1988 | [JP] | Japan | 63-302107 |
| Nov. 30, 1988 | [JP] | Japan | 63-304880 |
| Jul. 27, 1989 | [JP] | Japan | 1-196378 |
| Jul. 27, 1989 | [JP] | Japan | 1-196379 |
| Jul. 27, 1989 | [JP] | Japan | 1-196380 |
| Jul. 27, 1989 | [JP] | Japan | 1-196381 |

[51] Int. Cl.[5] ..... B22C 23/00; B22D 17/06

[52] U.S. Cl. ..... 164/305; 164/133; 164/308; 164/410

[58] Field of Search ..... 164/120, 122, 125, 127, 164/133, 137, 305, 306, 308, 309, 319, 342, 348, 119, 410

[56] References Cited

U.S. PATENT DOCUMENTS

| | | | |
|---|---|---|---|
| 401,804 | 4/1889 | Washburn | 164/DIG. 14 |
| 2,004,335 | 3/1929 | Merriman | 164/127 |
| 2,420,003 | 5/1947 | Miller | 164/DIG. 14 |
| 2,568,428 | 9/1951 | Billiar | 164/120 |
| 2,669,769 | 2/1954 | Peterson | 164/120 |
| 2,838,816 | 6/1958 | Strom | 164/DIG. 14 |
| 3,566,952 | 3/1971 | Lane | 164/120 |
| 3,656,539 | 4/1972 | Zickefoose | 164/309 |
| 4,252,173 | 2/1981 | Charbonnier | 164/119 |
| 4,352,388 | 10/1982 | Perrella | 164/305 |
| 4,606,396 | 8/1986 | Chandley | 164/350 |
| 4,889,177 | 12/1989 | Charbonnier et al. | 164/309 |

FOREIGN PATENT DOCUMENTS

| | | | |
|---|---|---|---|
| 2545178 | 5/1976 | Fed. Rep. of Germany | 164/306 |
| 2704321 | 8/1977 | Fed. Rep. of Germany | 164/309 |
| 2704322 | 8/1977 | Fed. Rep. of Germany | 164/309 |
| 3247129 | 6/1984 | Fed. Rep. of Germany | 164/306 |
| 58-81548 | 5/1983 | Japan | 164/119 |
| 61-180659 | 8/1986 | Japan | 164/120 |
| 62-118943 | 5/1987 | Japan | 164/122 |
| 63-72465 | 4/1988 | Japan | 164/98 |
| 63-242458 | 10/1988 | Japan | 164/305 |
| 63-281745 | 11/1988 | Japan | 164/305 |
| 725796 | 4/1980 | U.S.S.R. | 164/308 |
| 1587909 | 4/1981 | United Kingdom | 164/306 |

OTHER PUBLICATIONS

782955, Nov. 1980 Soviet Union.

*Primary Examiner*—Paula A. Bradley
*Assistant Examiner*—Rex E. Pelto
*Attorney, Agent, or Firm*—Darby & Darby

[57] ABSTRACT

A casting mold has a main body provided with a vent hole opened up in a casting space of said main body. The improvement is characterized in that the vent hole is provided with air discharging means and air feeding means which are disposed at the vent hole and the air discharging means and air feeding means are suitably selected so that air within the casting space can be discharged and a pressurized air can be fed toward the casting space through the vent hole.

15 Claims, 21 Drawing Sheets

CASTING DEVICE, METHOD FOR USING THE DEVICE, CASTING DEVICE OF VEHICLE WHEEL, METHOD FOR USING THE DEVICE, AND VEHICLE WHEEL

This is a continuation of application Ser. No. 388,322, filed Jul. 31, 1989 now abandoned.

BACKGROUND OF THE INVENTION

1. Field of the Invention

This invention relates to a casting device, a method for using the device, a casting device of a vehicle wheel, a method for using the device, and a vehicle wheel.

2. Brief Description of the Prior Art

In a conventional casting device, when a casting is going to be manufactured, a mold temperature is set sufficiently high in order to obtain a favorable run of a hot melt.

This conventional casting device, however, has such disadvantages as that as the mold temperature is set sufficiently high, it takes a long time for the hot melt to be hardened, and as a result, the casting structure of the casting does not become dense, and therefore, a high strength is difficult to obtain.

Also, in a conventional low pressure casting device of a vehicle wheel, a main body of a mold is provided at its lower part with a weir and a hot melt is poured into a casting space through this weir (Japanese Patent Early Laid-open Publication No. Sho 55-120465).

However, this conventional casting device has such disadvantages as that as the cooling device is disposed at a lower part of the main body of the mold, it is difficult to maintain the hot melt in a constant level of temperature, and as a result, a casting defect tends to occur.

Also, notwithstanding that a high strength is required for a disk portion of a vehicle wheel, as the weir is disposed as the lower part of the main body of the mold in the conventional casting device, it is difficult to cool the disk portion, and as a result, the disk portion is difficult to be improved in strength.

The present invention has been accomplished in order to overcome the above-mentioned disadvantages of the prior art.

SUMMARY OF THE INVENTION

It is therefore a first object of the present invention to provide a casting device, a method for using the device, a casting device of a vehicle wheel, and a method for using the device, in which as a favorable run of a hot melt is maintained without raising a mold temperature, a casting of a high density of casting structure, that is, a casting of a high strength can be obtained.

In order to achieve this first object, there is essentially provided a casting mold having a main body provided with a vent hole opened up in a casting space of said main body, the improvement being characterized in that said vent hole being provided with air discharging means and air feeding means which are disposed at said vent hole, said air discharging means and air feeding means being suitably selected so that air within said casting space can be discharging and a pressurized air can be fed toward said casting space through said vent hole.

The first object of the invention can also be achieved by a casting mold having a main body provided with a vent hole opened up in a casting space of said main body, a method for using a casting device comprising the steps of pouring a hot melt into said casting space and flowing a pressurized air into said vent hole after said hot melt reaches said vent hole.

The first object of the invention can also be achieved by a casting device of a vehicle wheel having a main body of a mold provided with a vent hole opened up in a casting space for molding a disk of said main body, an improvement being characterized in that said vent hole is provided with air discharging means and air feeding means, said air discharging means and said air feeding means being suitably selected so that air within said casting space for molding the disk can be discharged and a pressurized air can be fed toward said casting space through said vent hole.

The first object of the invention can also be achieved by a casting mold of a vehicle wheel having a main body of a mold provided with a vent hole opened up in a casting space for molding a disk of said main body, a method for using a casting device comprising the steps of pouring a hot melt into said casting space for molding a hub and flowing a pressurized air into said vent hole after said hot melt reaches said vent hole.

The first object of the invention can also be achieved by a casting device having a mold which is provided with a casting space and an auxiliary space formed at an upper part of said casting space within said mold and communicated with said casting space, said mold being provided with a pressurized air inlet hole so that a pressurized air can be introduced into said auxiliary space through said inlet hole, the improvement being characterized in that a communicating passage is formed on a border line between said casting space and said auxiliary space and said casting space is communicated with atmosphere through said communicating passage.

A second object of the present invention is to provide a casting device, in which a feeding head is excellent in heat retaining property.

The second object of the present invention can be achieved by providing, in a casting device provided with a space for forming a feeding head and communicated with a cavity, the improvement being characterized in that, in order to define said space for forming a feeding head, said casting device including a required number of annular casting members and a single number of disc-shaped casting member, said required number of annular casting members being stacked up one upon the other, said disc-shaped member being placed on an upper surface of said annular casting member arranged on an upper end.

A third object of the present invention is to provide a marking means, in which even when a casting mark is tiny, it can be clearly printed out.

The third object of the present invention can be achieved by a casting device provided with a casting mark forming portion on a wall surface of a casting space in a mold, wherein a marking means is characterized in that said mold is provided with an auxiliary space and an inlet hole for introducing a pressurized air, said auxiliary space is communicated with said casting space and said pressurized air inlet hole is opened up in said auxiliary space, and a border surface between said auxiliary space and said casting space is disposed in the vicinity of said casting mark forming portion.

A fourth object of the present invention is to provide a casting device for casting a vehicle wheel, in which no casting defect can be found, a casting structure is fine, and a disk portion is improved in strength.

The fourth object of the present invention can be achieved by a casting device of a vehicle wheel characterized in that a main body of a mold having a space section for forming a rim is provided at one side thereof with a weir which is opened up in said space section for forming a rim.

The fourth object of the invention can also be achieved by a casting device of a vehicle wheel characterized in that a main body of a mold having a space section for forming a rim is provided at one side thereof with a weir which is opened up at a connecting portion between said rim forming space section and a spoke portion forming space section.

The fourth object of the invention can also be achieved by a casting device of a vehicle wheel characterized in that a main body of a mold having a space section for forming a rim is provided at one side thereof with a plurality of dams which are opened up in said rim forming space section.

The fourth object of the invention can also be achieved by a casting device of a vehicle wheel having a rim forming space section which comprises a mold for forming an outer side of a design, a mold for forming a reverse side of a design, and a mold for forming an outer periphery of a rim, said rim outer periphery forming mold being formed with a hot melt passage, one end of said hot melt passage being opened up in said rim forming space section and the other end being opened up in an outer peripheral surface of said rim outer periphery forming mold, the improvement being characterized in including means for changing a hot melt flow passage communicated with an opening of the outer peripheral surface of said rim outer periphery forming mold.

The fourth object of the invention can also be achieved by a casting device of a vehicle wheel having a rim forming space section which comprises a mold for forming an outer side of a design, a mold for forming a reverse side of a design, and a mold for forming an outer periphery of a rim, said rim outer periphery forming mold being formed with a hot melt passage, one end of said hot melt passage being opened up in said rim forming space section and the other end being opened up in an outer peripheral surface of said rim outer periphery forming mold, the improvement being characterized in including means for changing a hot melt flow passage communicated with an opening of the outer peripheral surface of said rim outer periphery forming mold, a hot melt inlet port of said hot melt flow passage being opened up underneath.

The fourth object of the invention can also be achieved by a casting device of a vehicle wheel having a rim forming space section which comprises a mold for forming an outer side of a design, a mold for forming a reverse side of a design, and a mold for forming an outer periphery of a rim, said rim outer periphery forming mold being formed with a hot melt passage, one end of said hot melt passage being opened up in said rim forming space section and the other end being opened up in an outer peripheral surface of said rim outer periphery forming mold, the improvement being characterized in including means for changing a hot melt flow passage communicated with an opening of the outer peripheral surface of said rim outer periphery forming mold, said hot melt flow passage changing means being moved in such a manner as to be interlocked with said mold for forming a reverse side of a design.

The fourth object of the invention can also be achieved by a casting device of a vehicle wheel for forcefully feeding a hot melt within a hot melt reserving furnace into a mold through a weir, the improvement being characterized in including a plurality of molds in which cooling means is disposed in the vicinity of a disk forming space section, said weir is opened up in a rim forming space section and said weir is connected with the interior of said hot melt reserving furnace.

The fourth object of the invention can also be achieved by a casting device of a vehicle wheel for forcefully feeding a hot melt within a hot melt reserving furnace into a mold through a weir, the improvement being characterized in including a plurality of molds opened up in a rim forming space section, dams of the adjacent molds being communicated with each other, such communicated dams being connected with the interior of said hot melt reserving furnace.

The fourth object of the invention can also be achieved by a mold of a vehicle wheel having a rim forming space section as a casting space of a main body of said mold, said main body being provided with a weir which is opened up in said rim forming space section, the improvement being characterized in that cooling means is disposed in the vicinity of said weir in said main body.

The fourth object of the invention can also be achieved by a method for casting a vehicle wheel comprising the step of partially and separately forcefully cooling a disk portion of a cast vehicle wheel when the vehicle wheel is cast and cooled.

The fourth object of the invention can also be achieved by a mold of a vehicle wheel having a vehicle wheel like molding space formed in a main body of said mold, the improvement being characterized in that said main body is provided with primary cooling means generally uniformly arranged thereon, a disk forming portion in said main body comprising a nest, said nest being provided with auxiliary cooling means separately from said primary cooling means.

The fourth object of the invention can also be achieved by a mold of a vehicle wheel having a vehicle wheel like molding space formed in a main body of said mold, the improvement being characterized in that said main body is provided with primary cooling means generally uniformly arranged thereon, a disk forming portion in said main body comprising a nest, said nest being provided with auxiliary cooling means separately from said primary cooling means, said auxiliary cooling means being disposed under a prescribed portion of a bottle hole of the vehicle wheel which is to be cast.

A fifth object of the present invention can be achieved by providing a vehicle wheel, in which a clear safety of the wheel as an important part is shown by index.

The fifth object of the invention can be achieved by an aluminum alloy vehicle wheel characterized in that at a dendrite arm spacing measuring value, a DAS measuring value of a tip portion of a rim which is the most remote from a disk portion of the wheel being smaller than a measuring value of a rim body portion, a DAS measuring value of a rim carrying portion of said disk portion is smaller than a DAS measuring value of a central portion of said disk, said DAS measuring value of said rim carrying portion of said disk portion being equal to or smaller than said DAS measuring value of said rim body portion.

The above objects and still further objects of the invention will immediately become apparent to those skilled in the art after consideration of the following preferred embodiments of the invention which are provided by way of example and not by way of limitation.

DETAILED DESCRIPTION OF THE EMBODIMENTS

One preferred embodiment of a casting device of a vehicle wheel according to the present invention will be described with reference to FIGS. 1 through 5.

Figure 1:
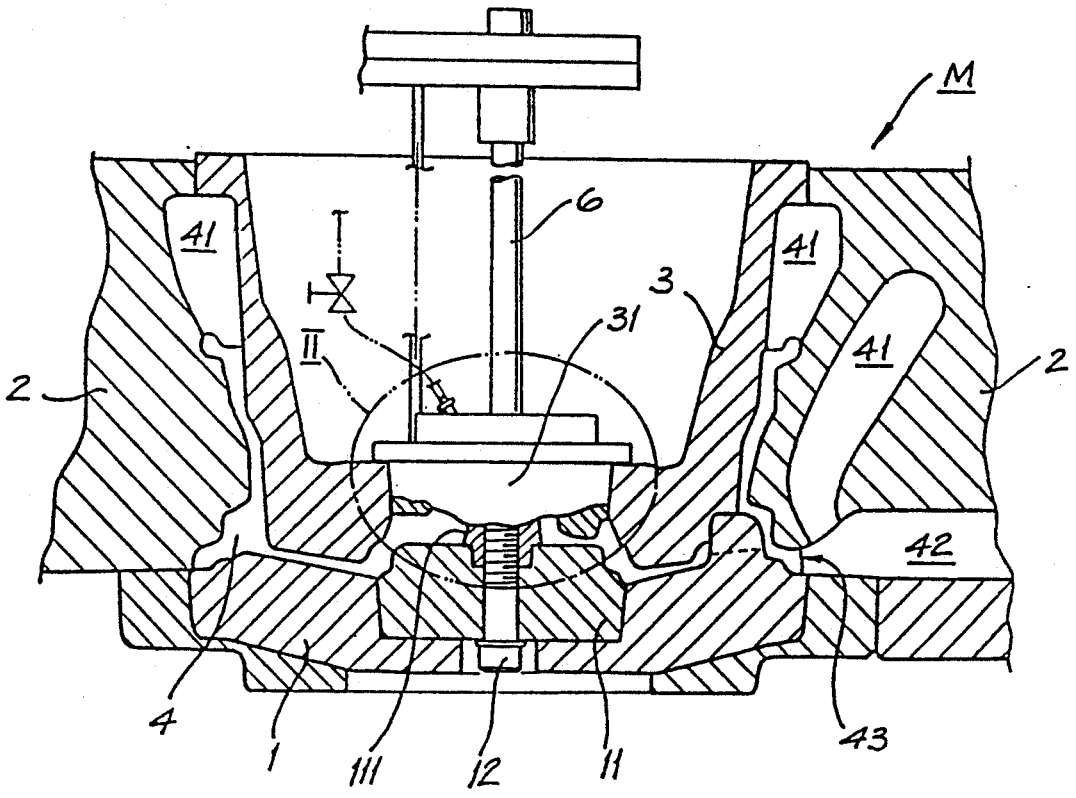
FIG. 1 is a partial sectional view of a casting device.

In FIG. 1, M denotes a mold for molding a vehicle wheel. The mold 1 comprises a combination of a lower mold 1, a horizontal mold 2 and an upper mold 3. This mold M has a casting space 4 of a vehicle wheel shape. 11 denotes a first nest of the lower mold 1 and is secured to a central portion of the lower mold 1 by a bolt 12. This first nest 11 shapes an outer surface of a hub portion (of the vehicle wheel). Also, 111 denotes a second nest of the lower mold 1 and is secured to the outer surface of the first nest 11 also by the bolt 12. This nest 111 shapes an axle hole of the vehicle wheel. Also, 31 denotes a nest of the upper mold 3 and is engaged with a central portion of the upper mold 3. This nest 31 shapes a rear surface of the hub portion (of the vehicle wheel). 41, 41, . . . denote a feeding head space, 42 denotes a hot melt passage communicated with the casting space 4, and 43 denotes a weir formed at the hot melt passage 42.

Figure 2:
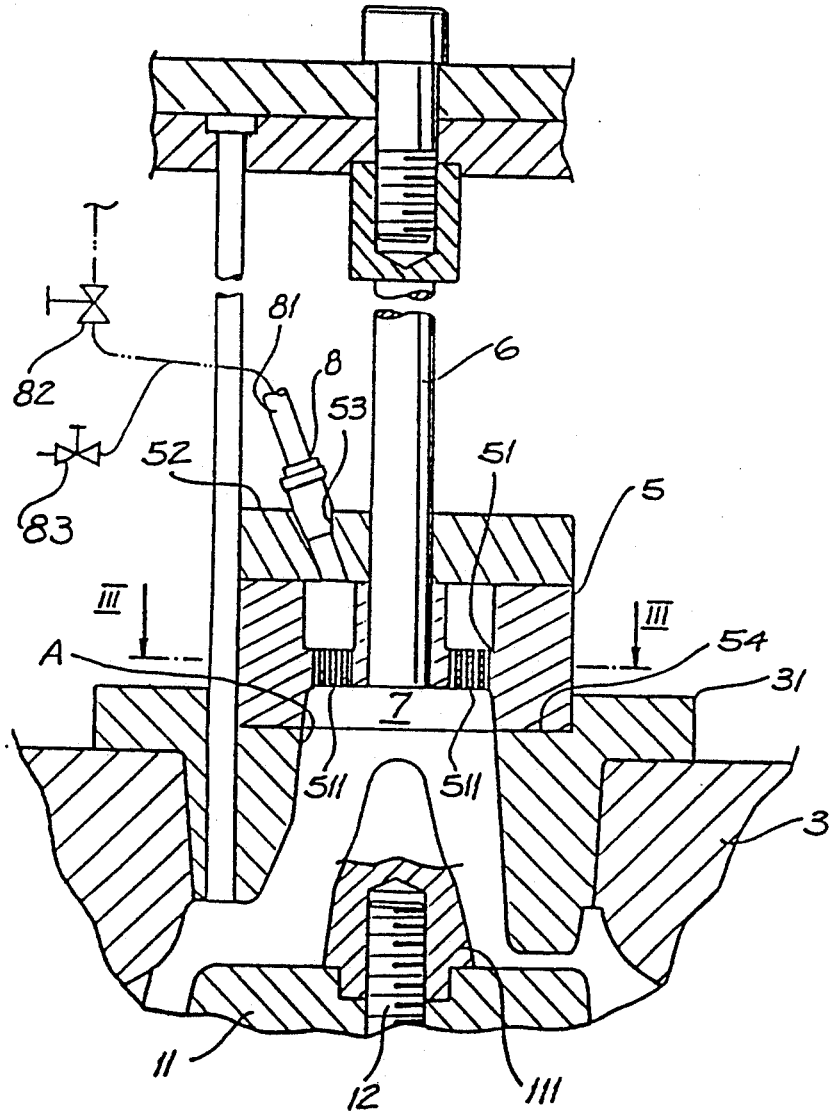
FIG. 2 is an enlarged sectional view of a portion indicated by II of FIG. 1.
Figure 3:
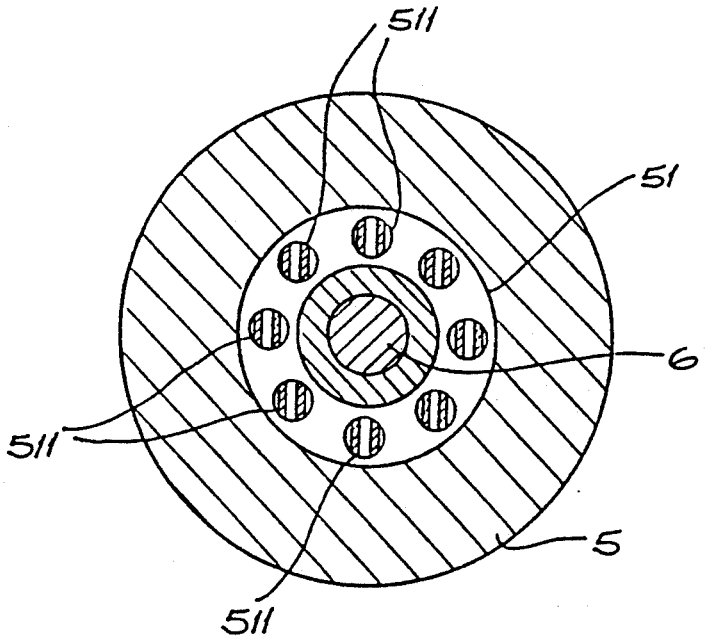
FIG. 3 is a sectional view taken on line III—III of FIG. 2.

Next, the nest 31 portion in the upper mold 3 will be described in detail with reference to FIGS. 2 and 3.

The nest (of the upper mold 3) 31 is opened up at its upper end, with which a vent barrel 5 is engaged. 6 denotes an extruding pin which is reciprocally movably inserted through the central portion of the vent barrel 5. Also, 51 denotes a partition wall which is integral with an intermediate portion of the vent barrel 5. The underneath of the partition wall 51 within the vent barrel 5 forms a vent room (corresponding to the "auxiliary space" 7. 54 denotes a contact surface between the vent barrel 5 and the nest (of the upper mold 3) 31 and corresponds to the communicating passage of this invention. Through this contact surface 54, the casting space 4 and the auxiliary space 7 are communicated with atmosphere. 511 ARE vent holes formed in the partition wall 51. Next, 52 denotes a lid member which covers the opening at the upper end of the vent barrel 5. The lid member 52 is formed with a pressurized air inlet hole 53. 8 denotes a connecting piece engaged with the inlet hole 53. 81 denotes a gas pipe connected with the connecting piece 8. By virtue of the foregoing arrangement, when a shutter valve 82 of the gas pipe 81 is opened, the pressurized air can enter into the vent barrel 5 and thus into the auxiliary space 7 through the connecting pipe 8.

A method for using such constructed casting mold M will be described next.

First, in the state where the pressurized gas feeding valve 82 is closed and a discharging valve 83 is opened, a hot melt is poured into the casting space 4. At this time, air within the casting space 4 is discharged through the discharge valve 83. And, when the hot melt reached a lower end portion of the vent room 7 (see the imaginary line of FIG. 2), the discharging valve 83 is closed and the pressurized gas feeding valve 82 is opened to feed the pressurized gas into the vent room (auxiliary space) 7 to raise the internal pressure of the vent room (auxiliary space) 7. Then, the surface of the hot melt now reaching the lower end portion of the vent room (auxiliary space) 7 is pressurized. As a result, the hot melt enters into every corner of the casting space 4 simply and easily. The hot melt A moves upward within the casting space 4. At this time, air within the casting space 4 is discharged into atmosphere through the contact surface 54. And, when the hot melts reaches the border line between the casting space 4 and the vent room (auxiliary space) 7, a gap of the contact surface 54 is blocked with the hot melt A. Therefore, air within the vent room (auxiliary space) 7 becomes unable to be discharged. As a result, the temperature of the hot melt is no more raised. Therefore, the interior of the vent room (auxiliary space) 7 is secured as a pressurized space.

And, the shutter valve 82 of the gas pipe 81 is opened to feed the pressurized air into the vent room (auxiliary space) 7 to raise the internal pressure of the vent room (auxiliary space) 7. Then, the surface of the hot melt A now reaching the lower end portion of the vent room (auxiliary space) 7 is pressurized. As a result, the hot melt A enters into every corner of the vent room (auxiliary space) 7 simply and easily.

As the casting device constructed as mentioned above, gas within the casting space can be discharged and a pressurized fluid can be fed in the direction of the casting space through the vent hole.

Accordingly, in the case that this casting device is used, a favorable run of a hot melt can be maintained without raising the temperature of the mold. Therefore, there can be obtained a casting of a high density of casting structure. i.e., a casting of high strength.

As the method for using the casting device is constituted as mentioned above, the surface of the hot melt within the casting space can be pressurized through the vent hole after the hot melt is poured. Accordingly, a favorable run of a hot melt can be enhanced.

Therefore, in the case that the method for using the casting device is carried out, a favorable run of a hot melt can be maintained without raising the temperature of the mold. Therefore, there can be obtained a casting of a high density of casting structure, i.e., a casting of high strength.

As the casting device of a vehicle wheel is constructed as mentioned above, gas within the disk forming casting space can be discharged and a pressurized fluid can be fed in the direction of the disk forming casting space through the vent hole.

Accordingly, in the case that this casting device is used, a favorable run of a hot melt can be maintained without raising the temperature of the mold. Therefore, there can be obtained a vehicle wheel of a high density of casting structure, i.e., a vehicle wheel of a high density of casting structure, i.e., a vehicle wheel of high strength.

As the method for using the casting device of a vehicle wheel is constituted as mentioned above, the surface of the hot melt within the disk forming casting space can be pressurized through the vent hole after the hot melt is poured. Accordingly, a favorable run of a hot molt can be enhanced.

Therefore, in the case that the method for using the casting device of a vehicle wheel is carried out, a favorable run of a hot melt can be maintained without raising the temperature of the mold. Therefore, there can be obtained a vehicle wheel of a high density of casting structure, i.e., a vehicle wheel of high strength.

As the casting device is constructed as mentioned above, that is, as a communicating passage is disposed on the border line between the casting space and the auxiliary space in a mold and the auxiliary space is communicated with atmosphere through this communicating passage. When a hot melt is poured into the casting space, the hot melt moves upward along the wall surface of the casting space, however, when the hot melt reaches the border line between the casting space and the auxiliary space, air within the auxiliary space becomes unable to be discharged, and therefore, the hot melt is not moved upward any further, and thus, the auxiliary space can be secured as a pressurized space.

Accordingly, in the case that this casting device is used, a favorable run of a hot melt can be maintained without raising the temperature of the mold. Therefore, there can be obtained a casting of a high density of casting structure, i.e., a casting of high strength.

Next, one embodiment will be described with reference to FIGS. 4 through 7.

Figure 4:
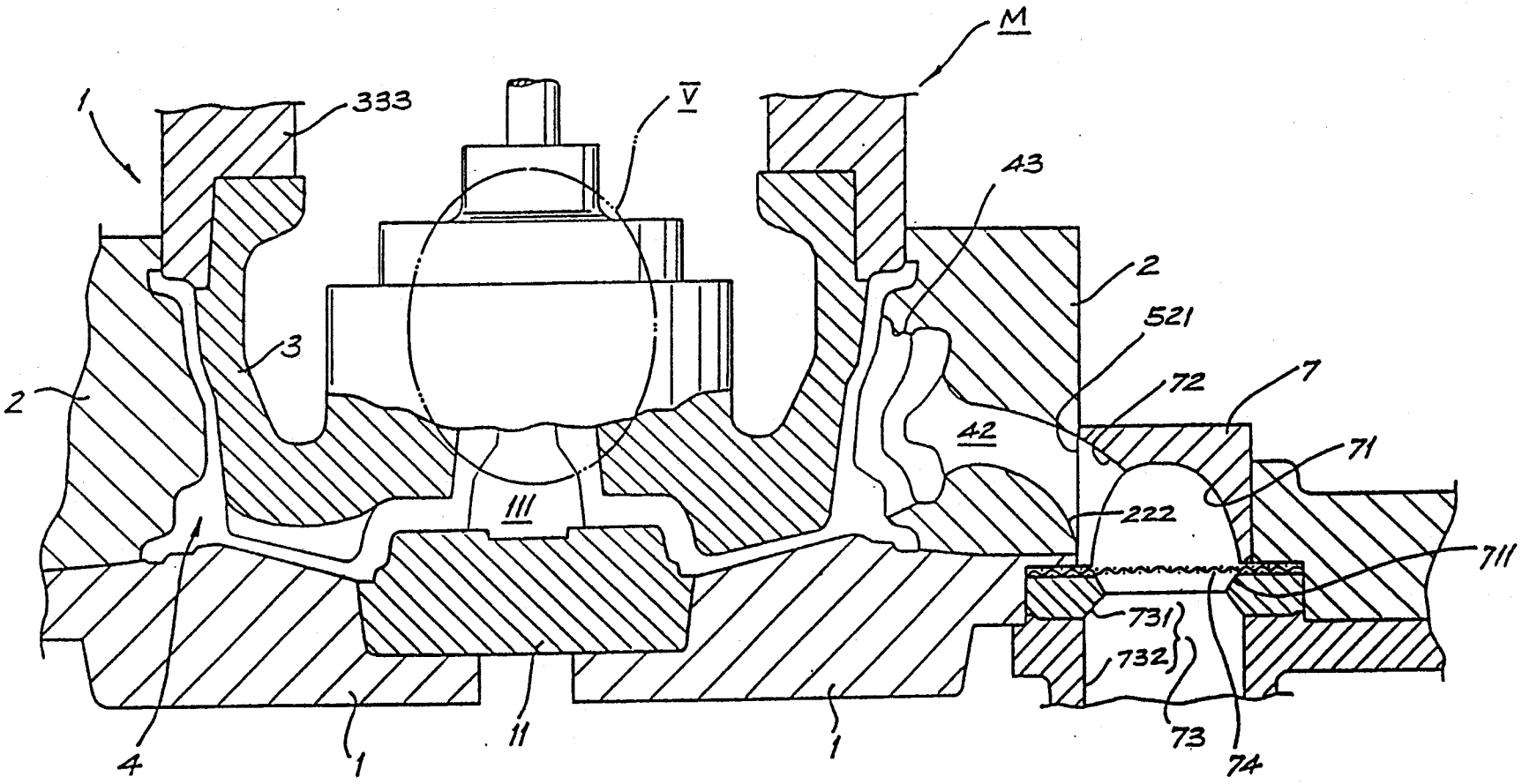
FIG. 4 is a sectional view of a casting device.

In FIG. 4, M denotes a casting device. The casting device M comprises a combination of a lower mold 1, an intermediate mold (first nest) 11, a horizontal mold 2, an upper mold 3, and an upper auxiliary mold 333. 4 denotes a cavity (casting space) of the casting device 1 and the cavity 4 has a shape like a vehicle wheel. 111 denotes a nest projecting from the intermediate mold 11 and extending inside the cavity 4. This nest 111 is adapted to form a shaft hole of the vehicle wheel. Next, 42 denotes a hot melt passage also extending sideward in the horizontal mold 2. This hot melt passage 42 is opened up at a side portion (rim forming space portion) of the cavity 4 through a weir 42. The other end of this hot melt passage 42 is opened up at an outer surface of the horizontal mold 2. 7 denotes an auxiliary mold which is intimately contacted with the outer side of the horizontal mold 2. 71 denotes a dome-shaped primary space which is formed inside the auxiliary mold 7 and opened up at a lower surface of the auxiliary mold 7. Similarly, 72 denotes a connecting passage which is formed in the auxiliary space 7 as in the case with the primary space 71. One end of this connecting passage 72 is opened up in the primary space 71, and the other end is opened up 721 at the left-hand side (in FIG. 4) of the auxiliary mold 7. And, the outer side opening 721 is opposite the outer side opening 222 of the hot melt passage 42. Accordingly, a hot melt within the primary space 71 passes through the connecting passage 72, and then can be flowed into the hot melt passage 42. 731 denotes a stroke auxiliary ring which is abutted against a peripheral edge portion of the lower side opening 711. Likewise, 732 denotes a stroke main body which is annexed to a lower side of the stroke auxiliary ring 731. The stroke main body 732 and the stroke auxiliary ring 731 integrally form the so-called "stroke". 74 denotes a flat plate-shaped filter which is held between the auxiliary mold 7 and the stroke auxiliary ring 731. This filter 74 shows a net-like configuration and is adapted to filtrate a hot melt which is to be fed to the auxiliary mold 7 as a hot melt changing device.

Figure 5:
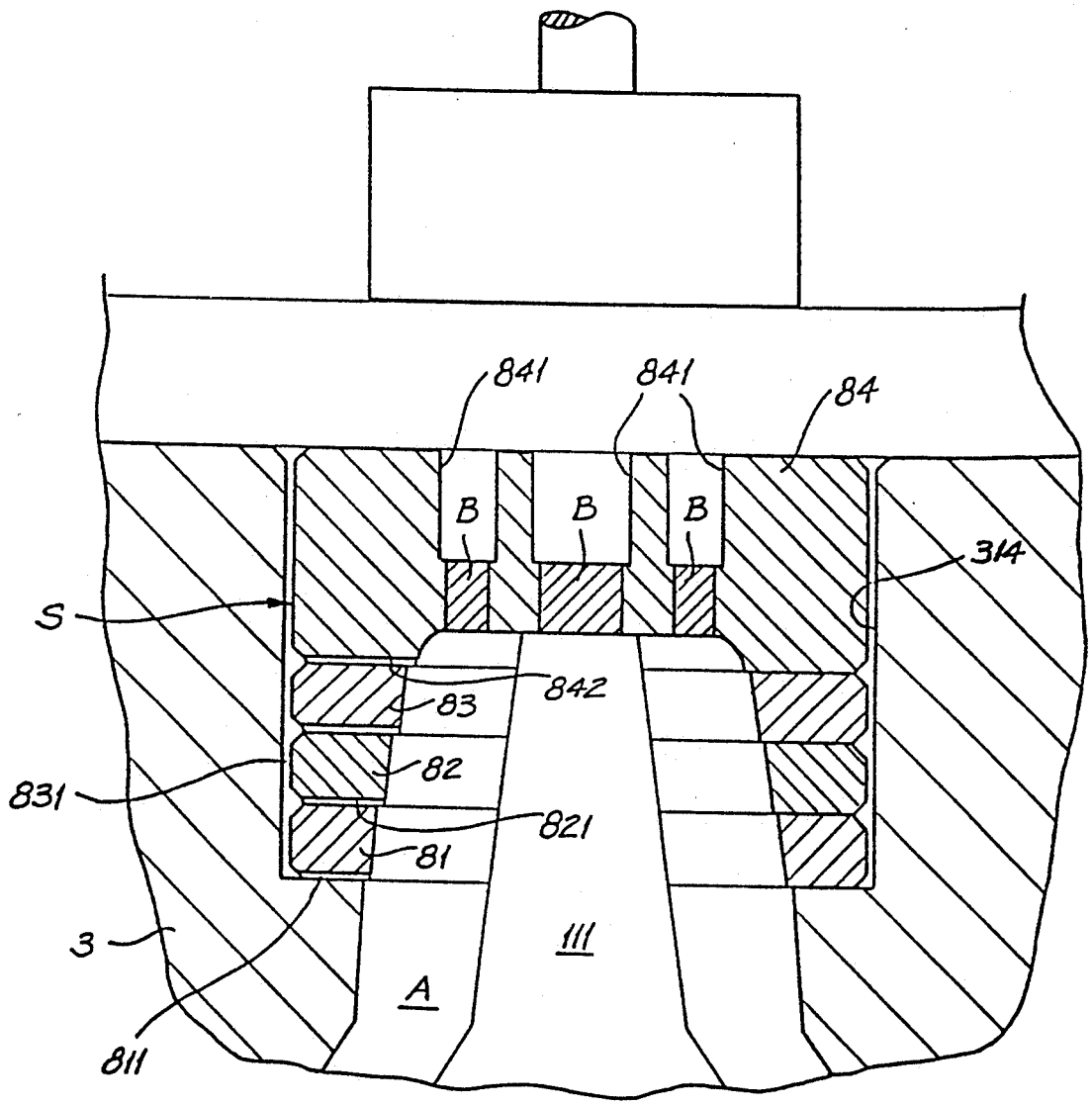
FIG. 5 is an enlarged sectional view of a portion indicated by V of FIG. 4.
Figure 6:
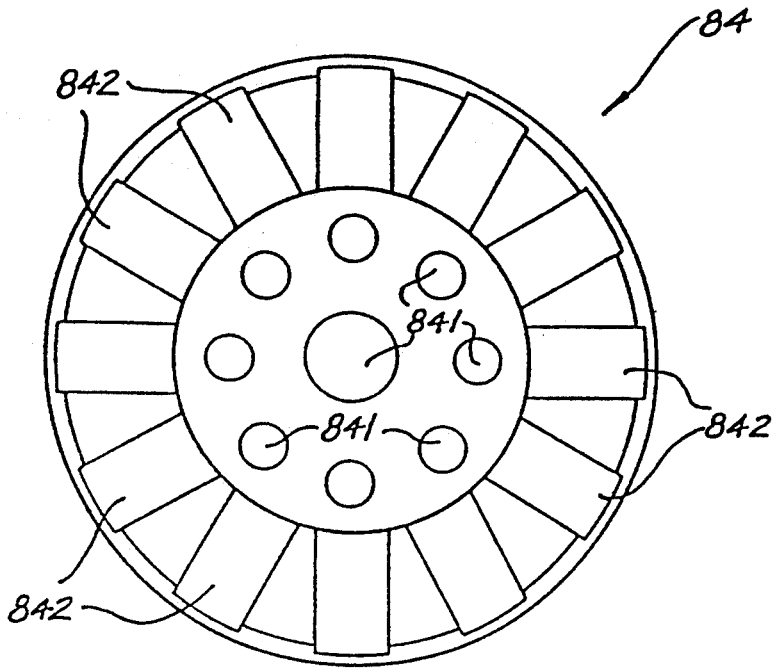
FIG. 6 is a bottom view of a disc-shaped molding member of FIG. 5.
Figure 7:
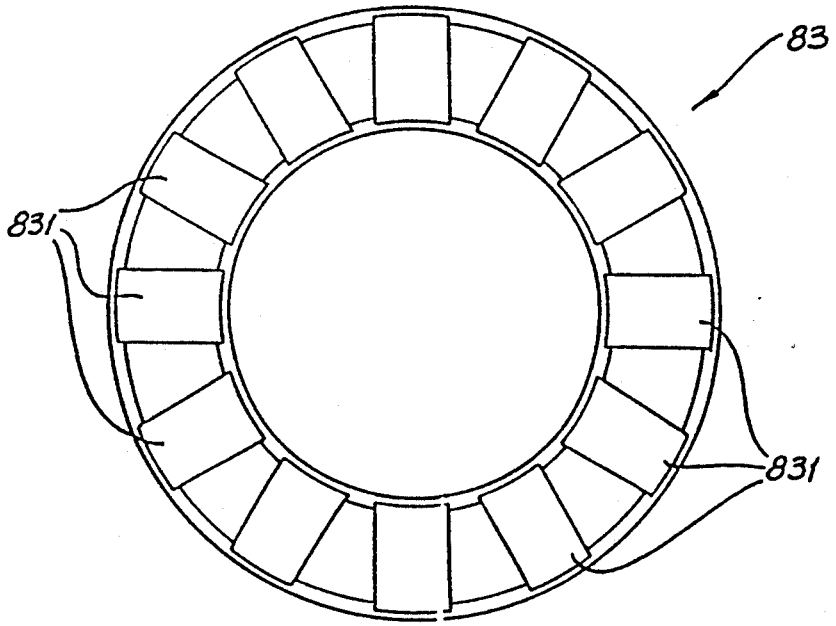
FIG. 7 is a bottom view of an annular molding member of FIG. 5.

Next, in FIG. 5, 314 denotes an inserting hole which is formed in an upper surface of a central portion in the upper mold 3. This inserting hole 314 is communicated with the cavity 4. 81, 82 and 83 denote annular molding members which are inserted into the inserting hole 314 through a space S and are then gradually stacked up one upon the other. In this embodiment, the inner diameter of the middle stage annular molding member 82 is larger than the inner diameter of the lower stage annular molding member 81. Similarly, the inner diameter of the upper stage annular molding member 83 is larger than the inner diameter of the middle stage annular molding member 82. The inner peripheral surface of the annular molding members 81, 82 and 83 are tapered and dilated toward the lower end thereof. And, connecting portions on the inner surface of each of the annular molding members 81, 82 and 83 shows a step-like configuration. This arrangement is made in order to prevent an occurrence of an undercut even when the annular molding members 81, 82 and 83 are moved by the space S in the horizontal direction within the inserting hole 314. 84 denotes a disc-shaped molding member which is inserted into the inserting hole 314 through the space S in the same manner as the annular molding member 81, 82, and 83. This disc-shaped molding member 84 is placed on the upper surface of the annular molding member 83 and forms a feeding head forming space A at an inner peripheral portion of the annular members 81, 82 and 83. A connecting portion between the disc-shaped molding member 84 and the annular molding member 83 is also formed with a step portion in order not to generate an undercut as mentioned. Also, in the disc-shaped molding member 84, 841, 841, . . . denote degasing holes, and A, B, . . . denote vents (see FIG. 6), 842, 831, 821 and 811 denote degasing grooves which are formed at the lower surfaces of the annular molding members 81, 82 and 83 (see FIGS. 6 and 7. FIG. G shows an annular molding member 85). These grooves 842, 831, 821 and 811, when stacked up, function as a degasing portion (see FIG. 5).

As the casting device is constructed as mentioned above, heat becomes difficult to conduct at the molding portion which forms the feeding head forming space.

Accordingly, in the case that this molding device is used, there can be obtained an excellent heat insulation of the feeding head.

Furthermore, in the molding device of this invention, as a space between the contact surfaces of the annular molding members and a space between the contact surfaces of the annular molding member and disc-shaped molding member can be utilized as degasing means when a hot melt is poured and the annular molding member and disc-shaped molding member can be independently moved, there can be arranged as such that a film of the hot melt can easily be destroyed by giving vibration.

One embodiment of the present invention will be described with reference to FIGS. 8 and 9.

Figure 8:
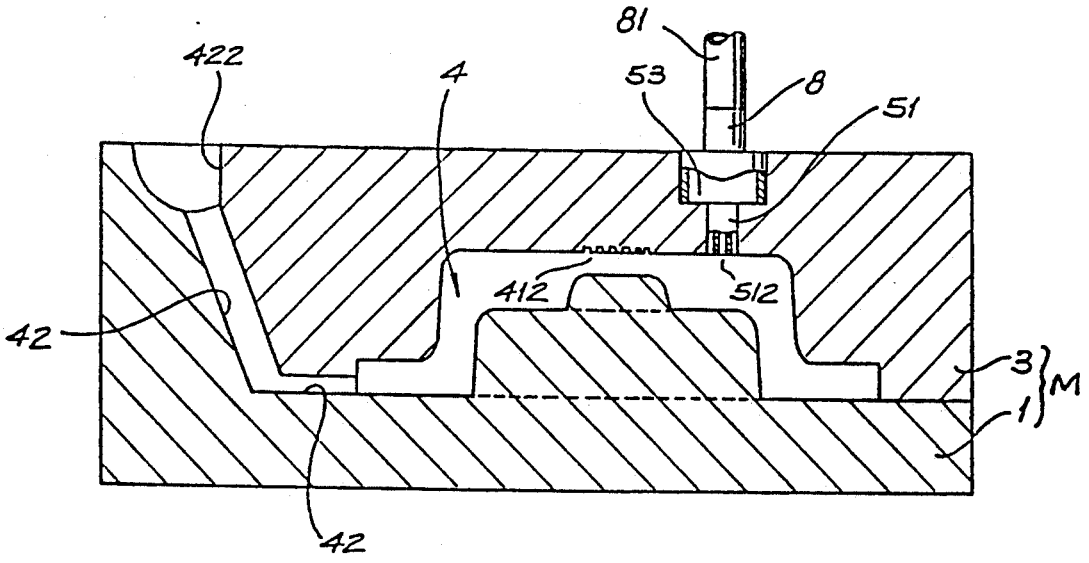
FIG. 8 is a sectional view of the mold of FIG. 7.
Figure 9:
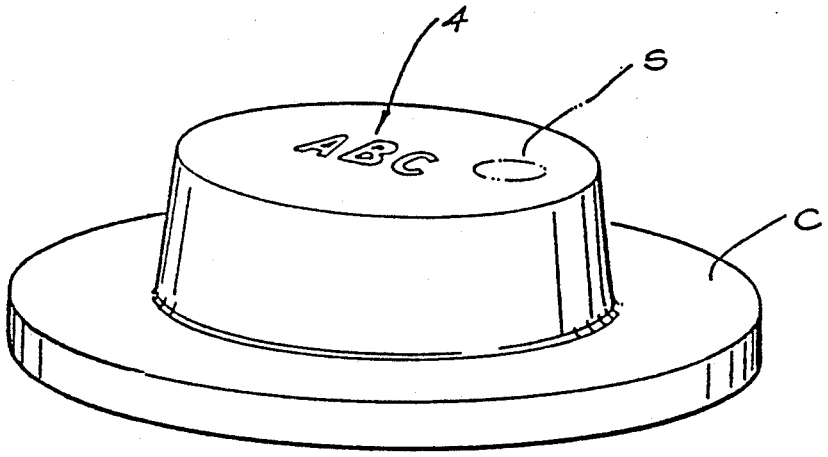
FIG. 9 is a perspective view of a casting cast by the mold of FIG. 8.

In FIG. 8, M denotes a mold for molding a wheel cap C which comprises a combination of a lower mold 1 and an upper mold 3. This mold M has a wheel cap-shaped molding space 4. Also, 422 denotes a hot melt port which is formed on the upper mold 3. Similarly, 42 denotes a hot melt passage which is formed in the upper mold 3 and on a border surface between the upper mold 3 and the lower mold 1. This hot melt 42 is continuous to the hot melt port 422 and opened up at the casting space 4.

Next, 412 denotes a casting mark forming portion which is formed on an upper wall surface of the casting space 4. This casting mark forming portion 4 is designed as such that a mark of "ABC" is printed out on the surface of the wheel cap C (FIG. 9).

Next, b1 denotes an auxiliary space which is formed in the upper mold 5. This auxiliary space 51 is opened up in the vicinity of the casting mark forming portion 412 in the casting space 4. That is, the border surface between the auxiliary space 51 and the casting space 4 is positioned in the vicinity of the mark forming portion 412. 512 denotes an air vent which is mounted on an opening end of the auxiliary space 51. This air vent 512 is adapted to prevent the hot melt from entering into the auxiliary space 51. 53 denotes a pressurized fluid inlet hole which is formed in the upper mold 3. This pressurized fluid inlet hole 53 is communicated with an upper end portion of the auxiliary space 51. 8 denotes a connecting pipe which is inserted in the pressurized fluid inlet hole 53. Through this connecting pipe 8, the pressurized fluid inlet hole 53 and the gas pipe 81 are connected with each other.

Next, the operation of such constructed marking means will be described.

First, a hot melt is poured into a casting space through the hot melt port 422 and the hot melt port 42. And, after a hot melt is filled into the casting space 4, a pressurized gas is fed into the auxiliary space 51 through the pressurized fluid inlet hole 53 to raise the internal pressure of the auxiliary space 51. Then, the surface S of the hot melt which now reaches the lower end portion of the auxiliary space 51 (see FIG. 9) is pressurized. As a result, as the hot melt in the vicinity of the auxiliary space 51 is strongly pushed against the wall surface of the casting space 4, the hot melt is also strongly pushed against the casting mark forming portion 412. As a result, a casting mark is clearly formed thereon.

As the marking means is constructed as mentioned above, when a pressurized gas is introduced into the auxiliary space after the hot melt is poured into the casting space, the internal pressure of the auxiliary space pressurizes the surface of the hot melt (the border surface with respect to the auxiliary space). As a result, as the hot melt in the vicinity of the auxiliary space is strongly pushed against the wall surface of the casting space, the hot melt is also strongly pushed against the mark forming portion.

Therefore, if this marking means is used, even a tiny mark, for example, can clearly be printed out.

One embodiment of the present invention will now be described with reference to FIG. 10.

Figure 10:
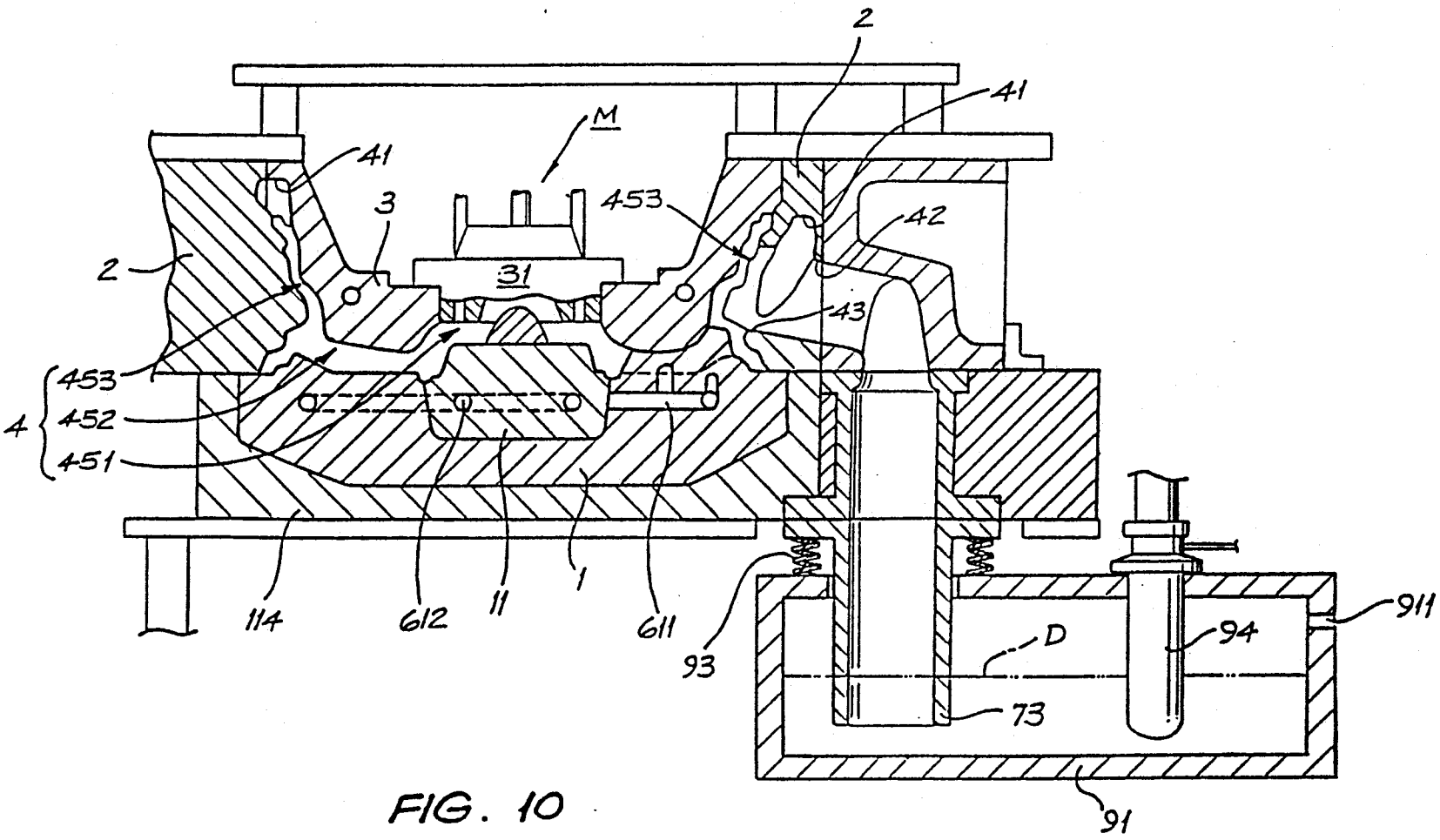
FIG. 10 is a sectional view of one embodiment.

In FIG. 10, M denotes a main body of a mold for molding a vehicle wheel. The mold main body M comprises a combination of a lower mold 1, horizontal molds 2, 2, and an upper mold 3. The lower mold 1 is supported by a supporting device 114. 4 denotes a casting space which is formed in the mold main body M. This casting space 4 has a configuration like a vehicle wheel, and comprises a disk forming space portion 451, a spoke portion forming space portion 452, and a rim forming space portion 453. Next, 11 denotes a nest of the lower mold 1. The nest 11 forms the outer surface of the disk portion (of the vehicle wheel). Also, 31 denotes a nest of the upper mold 3. The nest 31 forms the rear surface of the disk portion (of the vehicle wheel).

Next, oil denotes a primary cooling hole formed in the lower mold 1, and 612 denotes an auxiliary cooling hole formed in the nest 11. By refluxing a cooling fluid. for example, a cooling water, into these cooling holes 611 and 612, the lower mold 1 and the nest (of the lower mold 1) 11 is cooled.

Also, 42 denotes a hot melt passage which is formed in the horizontal mold 2. This hot melt passage 42 is continuous to the rim shaping space portion 453 through the weir 43. A hot melt passed through the hot melt passage 42 is fed into the casting space 4 through this weir 43. 41 denotes a feeding head space continuous to the hot melt passage 42.

Next, 91 denotes a hot melt reserving furnace which contains a hot melt therein. 73 denotes a feed hot melt pipe which is mounted on the hot melt reserving furnace 91. An upper end of the feed hot melt pipe 73 is communicated with the hot melt passage 42 of the horizontal mold 2. Accordingly, when a pressurized air is flowed through the air hole 911 to pressurize the surface of the hot melt D. the hot melt D is pushed up through the feed hot welt pipe 73 and poured into the casting space 4 through the hot melt passage 42. 93 denotes a bellows disposed between the hot melt reserving furnace 91 and the feed hot melt pipe 73, and 94 denotes a heater for maintaining the hot melt D in a constant temperature.

Figure 11:
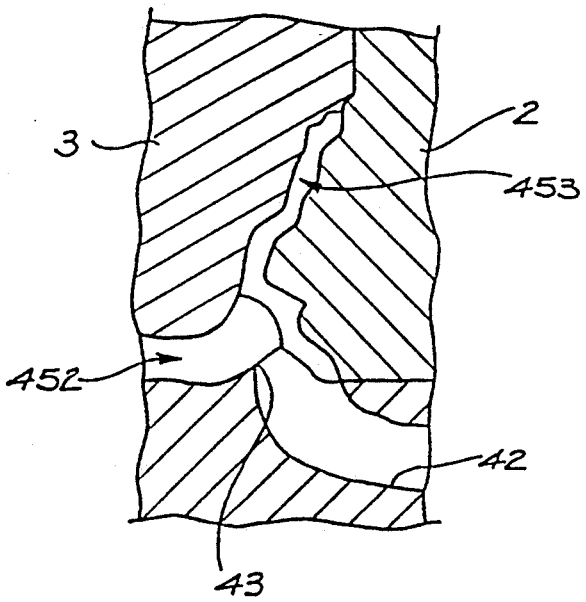
FIG. 11 is a sectional view of one embodiment.

Also, as shown in FIG. 11, the weir 43 may be opened up at the connecting portion between the spoke portion forming space 452 and the rim portion forming space 453.

As the casting device of a vehicle wheel is constructed as mentioned above, cooling means can be disposed at a lower portion of the casting space. As a result, as the hot melt passes through a place which is away from the cooling device, the hot melt can easily be maintained in a constant temperature.

Also, as a large space is available at a lower portion of the main body of the mold, the disk portion can sufficiently be cooled.

Accordingly, if a casting device of a vehicle wheel is used, there can be obtained a vehicle wheel, in which no casting defect can be found, casting structure is minute, and the strength of the disk portion is improved.

Figure 12:
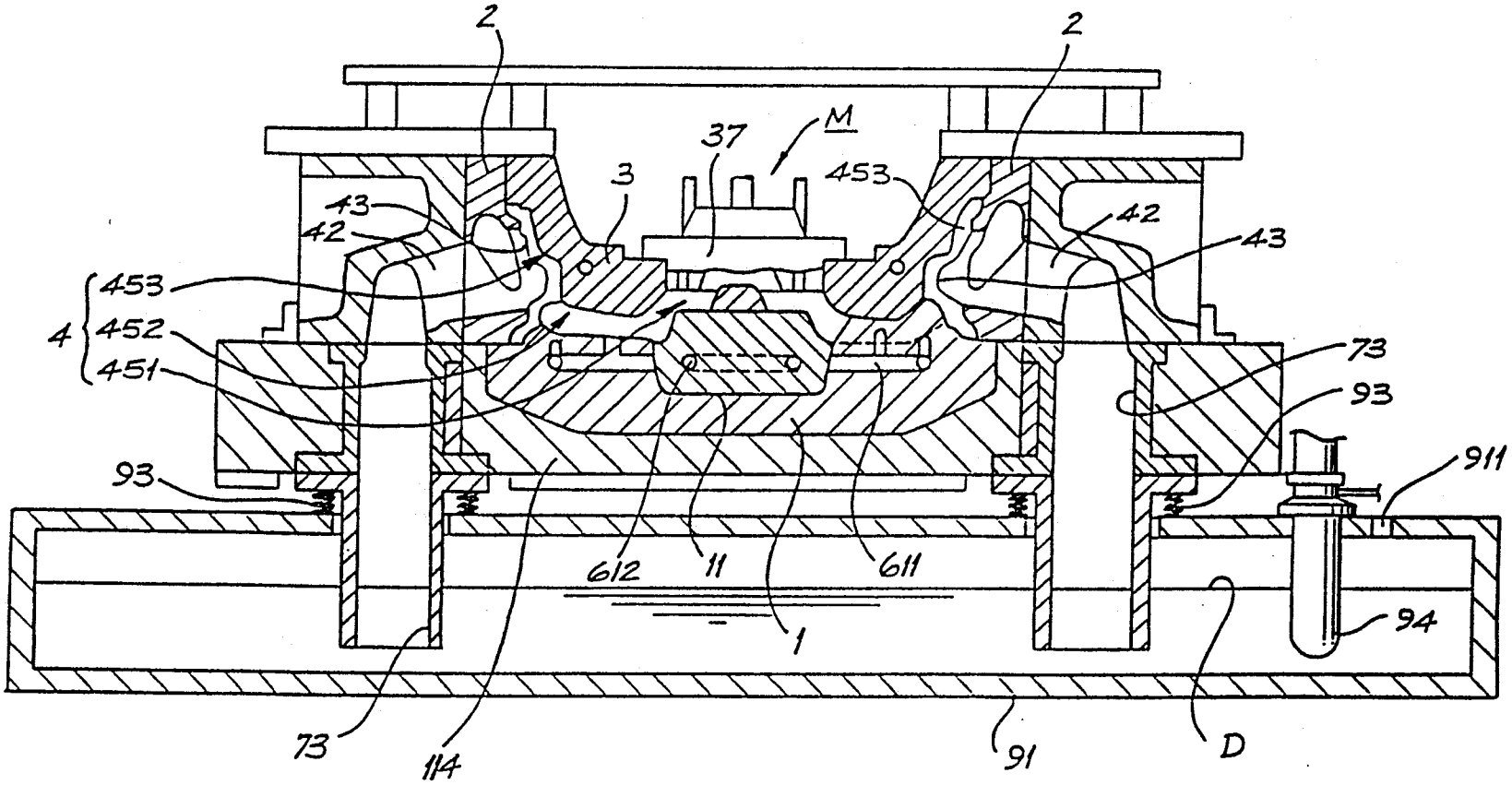
FIG. 12 is a sectional view of one embodiment.

FIG. 12 shows one embodiment of claim 10. This embodiment is only difference from the embodiment of FIG. 10 in the respect that a plurality of feed hot melt pipes 73, 73 are provided, and these pipes 73, 73 are communicated with a rim forming space portion 453 through the hot melt passages 4, 42 and weirs 42, 42. Therefore, as time for pouring the hot melt can be shortened, productivity can be improved.

Figure 13:
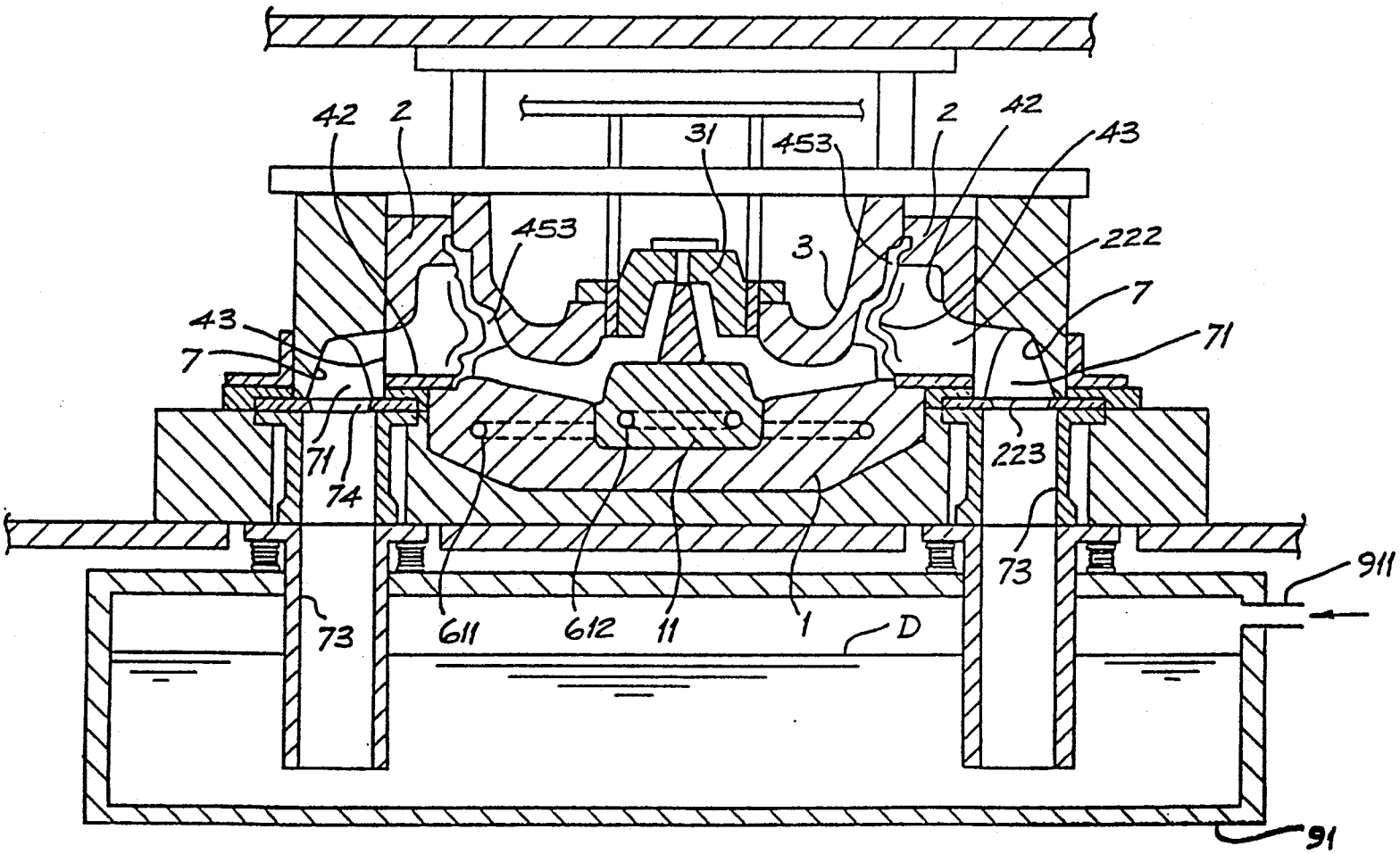
FIG. 13 is a sectional view of one embodiment.

FIG. 13 shows one embodiment of the present invention. In the figure, the lower mold 1 corresponds to a design outer side mold. The upper mold 3 corresponds to a design rear side mold, and the horizontal mold 2 corresponds to a rim outer side mold. 7 denotes hot melt flow passage changing means (auxiliary type). One end of the hot melt fluid passage is communicated with the hot melt port 222 and the other end thereof is communicated with a hot melt inlet port 223 opened up underneath. Also, this hot melt inlet port 223 is connected with the stock 73 through the flat plate-shaped filter 94. Furthermore, the hot melt flow passage changing means 7 is mounted as such that the means 7 can be interlocked with the upper mold (disk rear side mold) 31 and the upper mold (design rear side mold) 3.

Accordingly, the casting device of a vehicle wheel of this embodiment exhibits the following technical effects. As a large space is available in the vicinity of the disk portion, the disk portion can sufficiently be cooled. As a result, the structure of the disk portion of the vehicle wheel which is obtained by means of casting can be miniaturized, and the strength thereof can be improved. Also, as hot melt flow passage changing means communicated with the hot melt port is disposed on the outer peripheral surface of the rim, for example, by removing only the thin plate-shaped hot melt passage portion from the mold first, an occurrence of bending or separation of the thin plate-shaped hot melt passage portion can be prevented.

Figure 14:
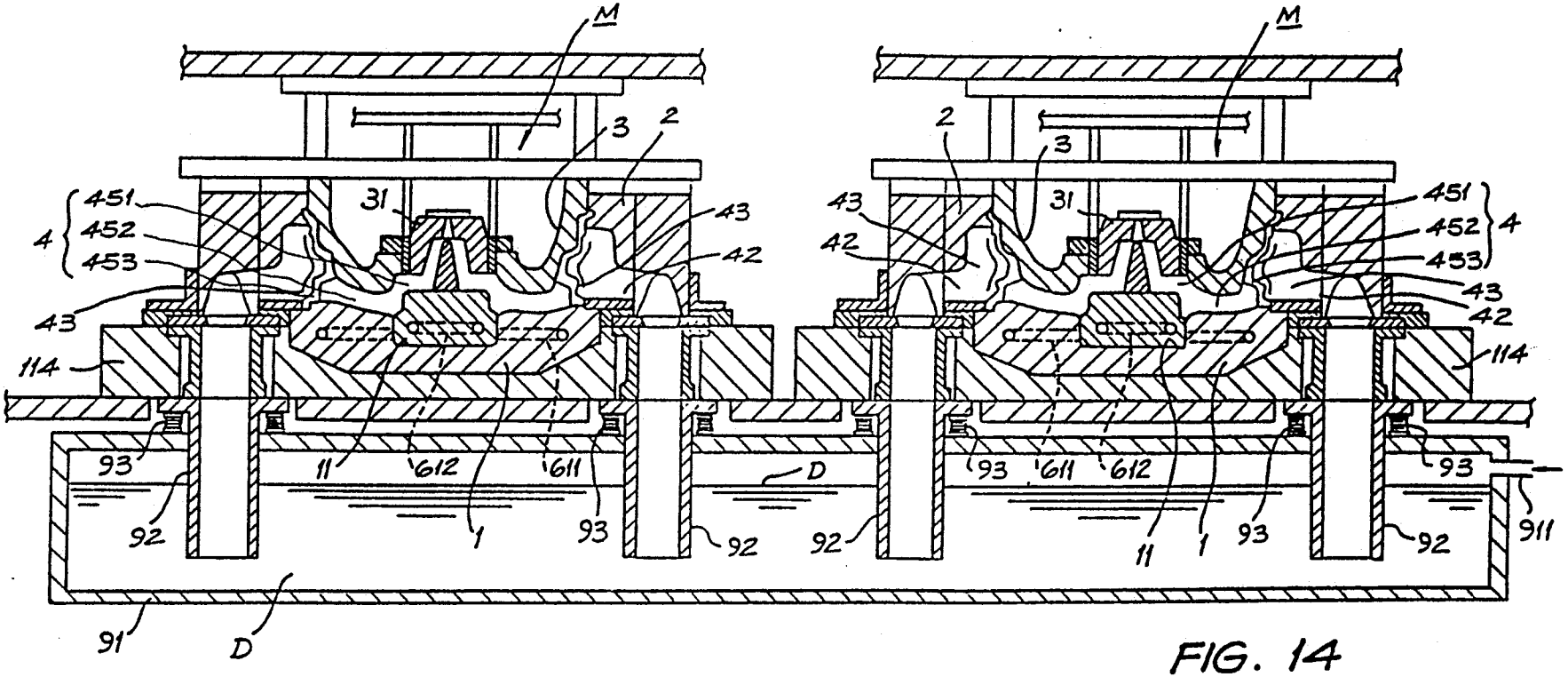
FIG. 14 is a sectional view of one embodiment.

FIG. 14 shows one embodiment the present invention. This embodiment is characterized in that a hot melt reserving furnace 91 is connected with a main body M of a mold.

Accordingly, in this mold of a vehicle wheel, casting productivity can be improved, and heat losses of a hot melt within the hot melt reserving furnace can be minimized.

Figure 15:
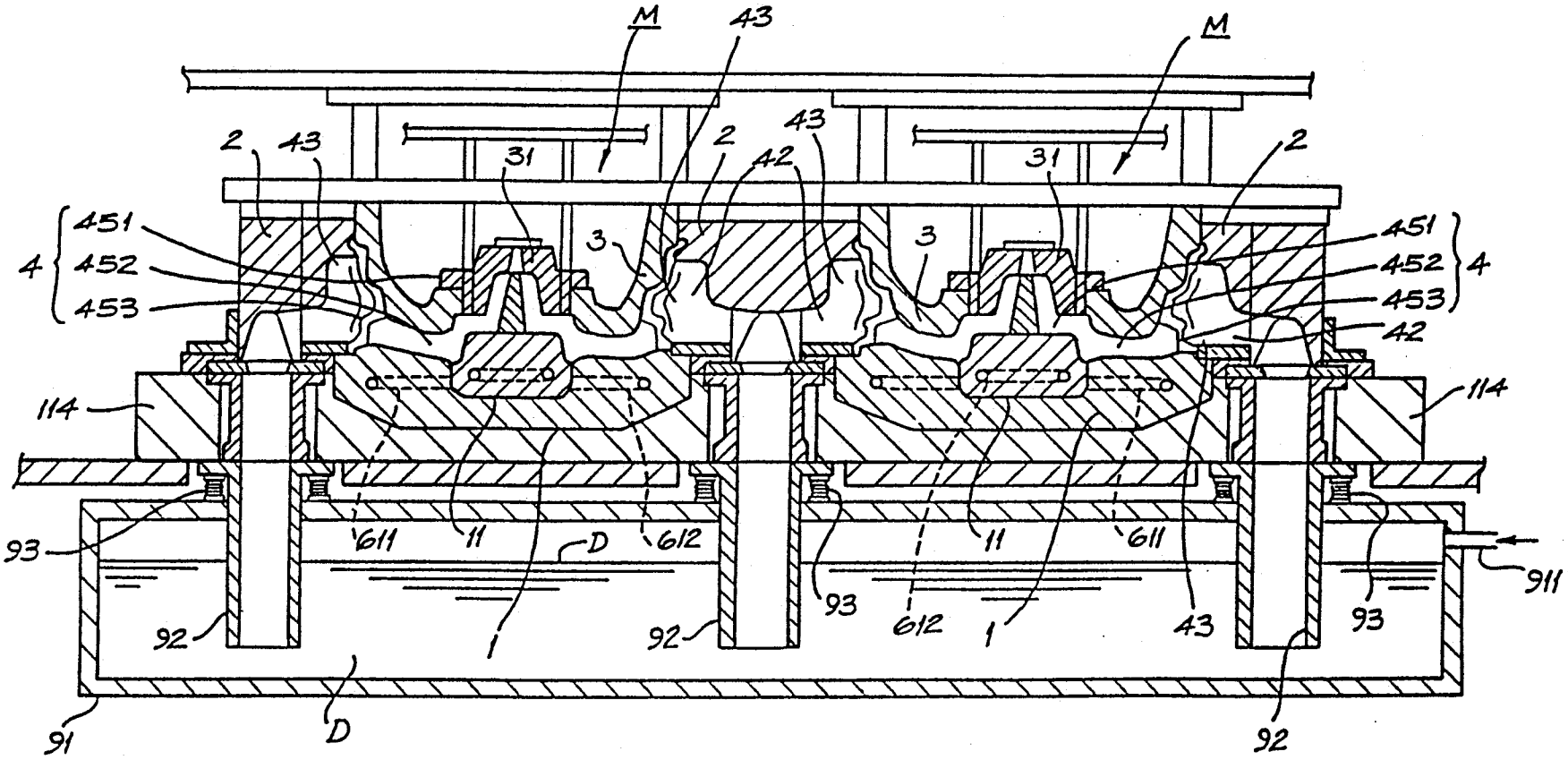
FIG. 15 is a sectional view of one embodiment.
Figure 16:
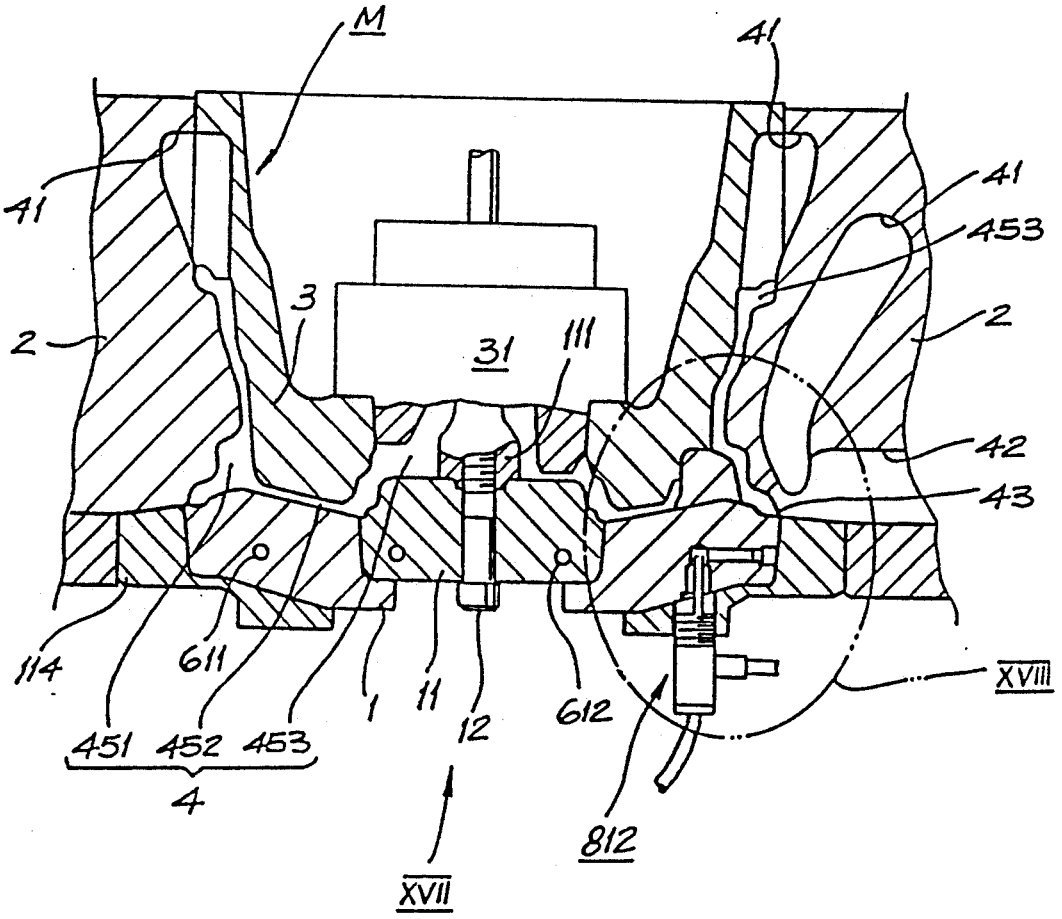
FIG. 16 is a sectional view of one embodiment.

FIG. 15 shows one embodiment of the present invention. This embodiment is characterized in that adjacent weirs of the mold M are communicated with each other.

Accordingly, in this mold of a vehicle wheel, heat losses of the hot melt can be minimized, and the casting device can be miniaturized.

FIGS. 16 through 20 show one embodiment of claims 16 through 19.

M denotes a main body of a mold for molding a vehicle wheel. The mold main body M comprises a combination of a lower mold 1, horizontal molds 2, 2, and an upper mold 3. The lower mold 1 is supported by a supporting device 114, 4 denotes a casting space which is formed in the mold main body M. This casting space has a shape like a vehicle wheel and comprises a disk shaping space portion 453, a spoke portion shaping space portion 452, and a rim shaping space portion 451. Next, 11 denotes a first nest of the lower mold 1 which is secured to the central portion of the lower mold 1 by a bolt 12. This first nest 11 forms the outer surface of a disk portion (of the vehicle wheel). Similarly, 111 denotes a second nest of the lower mold 1 which is secured to the outer surface of the first nest 11 also by the bolt 12. This second nest 111 forms an axle hole of the vehicle wheel. Also, 31 denotes a nest of the upper mold 3. The nest 31 is inserted in the central portion of the upper mold 3. This nest 31 forms a rear surface of the disk portion (of the vehicle wheel).

Next, 42 denotes a hot melt passage which is formed in the horizontal mold 2. This hot melt passage 42 is continuous to the rim shaping space portion 453 through the weir 43. The hot melt, which passed the hot melt passage 42, is fed into the casting space 4 through the weir 43, 41 denotes a feeding head space.

Figure 17:
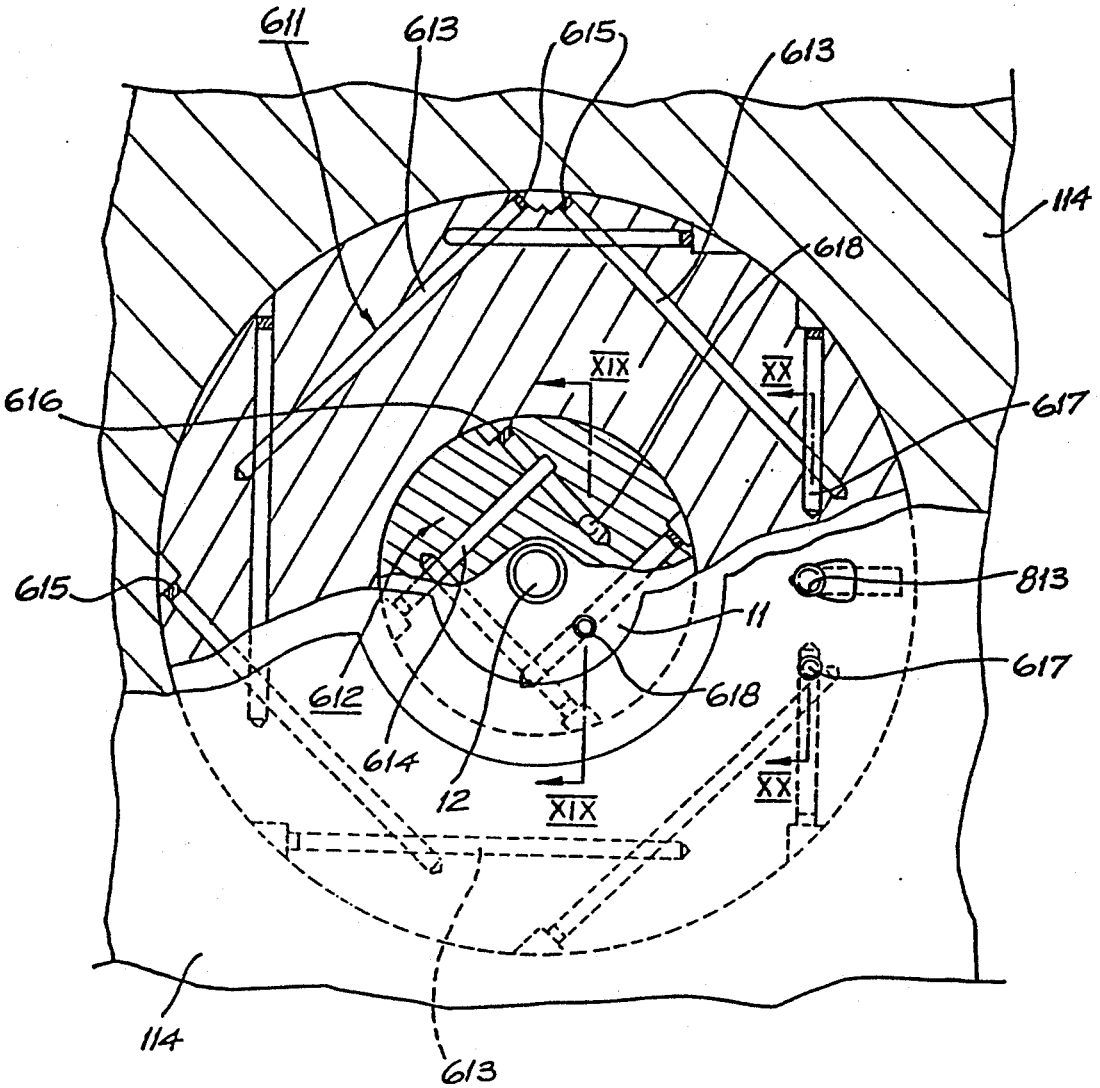
FIG. 17 is a partial sectional view of a portion indicated by an arrow of FIG. 16.
Figure 18:
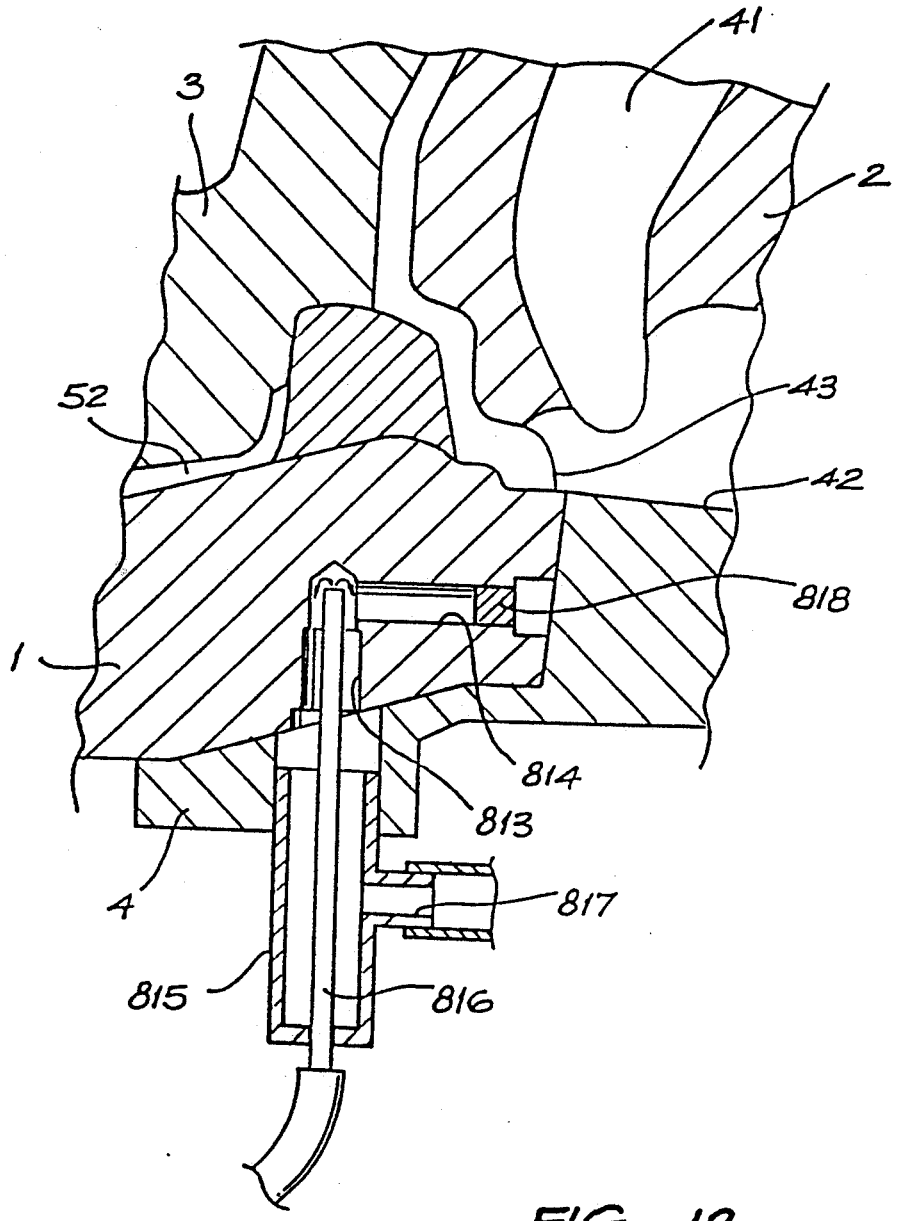
FIG. 18 is an enlarged view of a portion indicated by XVIII of FIG. 16.
Figure 19:
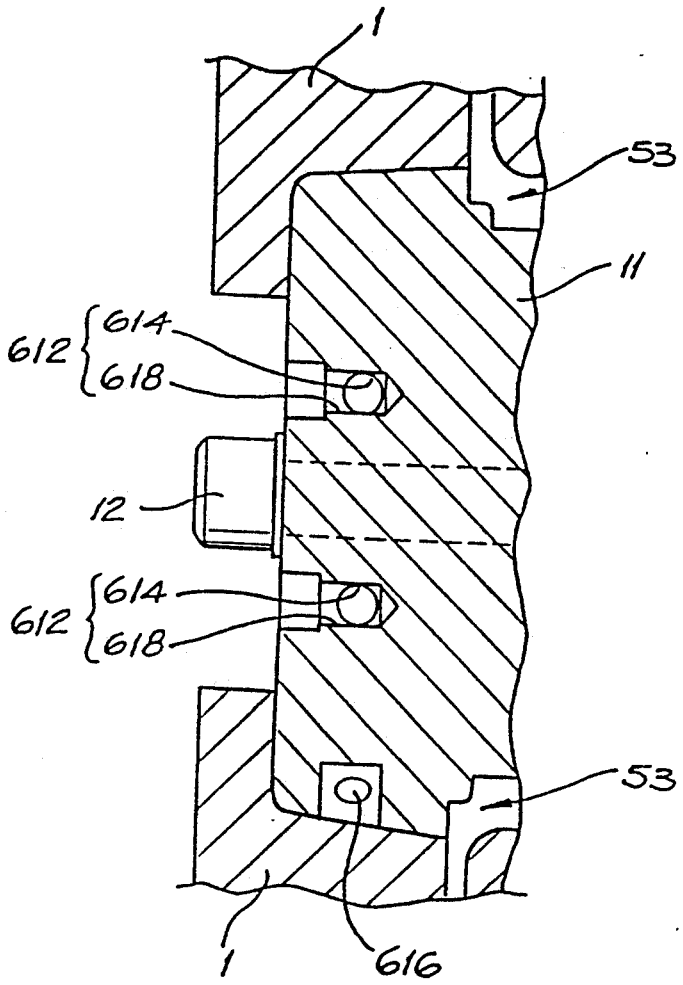
FIG. 19 is a sectional view taken on line XIX—XIX of FIG. 17.
Figure 20:
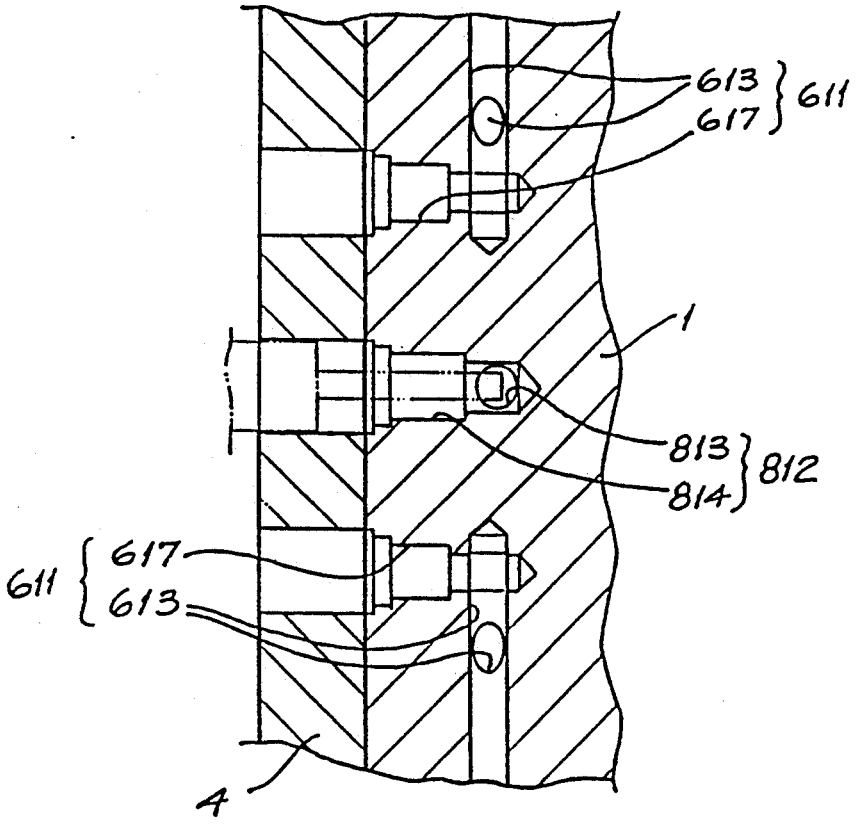
FIG. 20 is a sectional view taken on line XX—XX of FIG. 17.

Next, in FIGS. 17 and 20, 613, 613, . . . denote straight holes which are formed in the lower mold 1. These straight holes 613, 613, . . . are blocked at the end portions with blind plugs 615, 615, . . . and annularly communicated with each other to form a primary cooling flow passage (corresponding to the "primary cooling means") 611. 617 and 617 denote connecting holes which are formed in the lower mold 1 in the vertical direction (see FIG. 5). Each of these connecting holes 617, 617 is communicated with the end portion of the primary cooling flow passage 611. Through these connecting holes 617, 617, a cooling water is fed into the primary cooling flow passage 611 to forcefully cool the lower mold 1 and thus the mold main body M.

Next, in FIGS. 17 through 19, 614, 614 denote auxiliary straight holes which are formed in the first nest 11. These auxiliary straight holes 614, 614, . . . are blocked at the end portions thereof with blind plugs 616, 616, . . . and annularly communicated with each other to form a first auxiliary cooling flow passage (corresponding to the "auxiliary cooling means") 7. 618 and 618 denote connecting holes which are formed in the first nest 11 in the vertical direction (see FIG. 5). Each of these connecting holes 618, 618 is communicated with the end portion of the first auxiliary cooling flow passage 612. Through these connecting holes 618, 618, a cooling water is fed into the first auxiliary cooling flow passage 612 to forcefully cool the first nest 11 and thus the mold main body M.

Next, in FIGS. 17, 18 and 20, 813 denotes a vertical hole which is formed between the connecting holes (of the primary cooling flow passage 611) 617, 617 in the lower mold 1. This vertical hole 813 is disposed in the vicinity of the weir 43 and is provided with a cooling device 815 secured thereto by screw means. This cooling device 815 has a nozzle 816 and jets a cooling fluid such as, for example, a cooling water into the vertical hole 813 through the nozzle 816. 817 denotes a water discharging port of the cooling device 815. Similarly, 814 denotes a horizontal hole which is formed in the vicinity of the weir 43 at the side surface of the lower mold 1. This horizontal hole 814 is blocked at its opening end with a blind plug 818 and communicated at its end portion with the vertical hole 813. The vertical hole 813, the horizontal hole 814, and the cooling device 815 form the second auxiliary cooling flow passage (corresponding to the "cooling means") 812. When a cooling water is fed through the vertical hole 813, area in the vicinity of the weir 43 of the lower mold 1 can concentratedly be cooled.

As the casting device of a vehicle wheel is constructed as mentioned above, a hot melt within the rim shaping space which is in the vicinity of the weir can more effectively cooled than a hot melt elsewhere.

Accordingly, if this mold of a vehicle wheel is used, even when a weir is formed in the rim shaping space portion. a hot melt forming these portions can generally simultaneously be hardened with a hot melt forming other portion. As a result, the structure of a vehicle wheel, which is to be cast, becomes uniform and thus, the rigidity thereof becomes uniform.

As a method for casting a vehicle wheel is constituted as mentioned above, the structure of a vehicle wheel obtained by means of casting can be miniaturized.

Accordingly, in this casting method, as only the hub portion is forcefully cooled, when a vehicle wheel is cast, the strength of a bolt hole in the hub portion can easily be obtained at low cost.

As a method for casting a vehicle wheel is constituted as mentioned above, by cooling effects owing to the auxiliary cooling means, it is difficult to be conducted to other mold portion. As a result, the casting of the vehicle wheel can easily be practiced.

When the auxiliary cooling means, is disposed at a lower part of a bolt hole predetermined portion of the vehicle wheel, the bolt hole predetermined portion can be partly cooled.

One embodiment of a vehicle wheel of claim 20 will be described with reference to FIG. 23.

As an indication of a size in a microstructure of a casting of an aluminum casting lump, a dentrite arm spacing (DAS) is measured.

Figure 21:
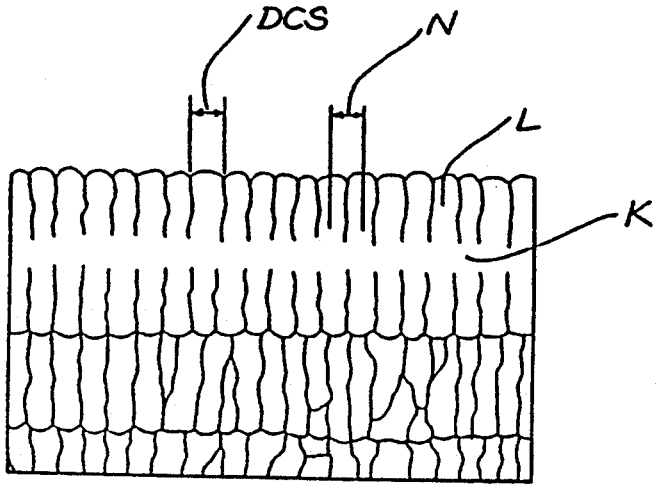
FIG. 21 is a schematic view showing a secondary branch (secondary arm) growing at each side of a main shaft of a dendrite in an aluminum alloy.

The dentrite in an aluminum alloy, as schematically shown in FIG. 21, has a secondary branch (secondary arm) growing at each side of a main shaft (k). By measuring DAS, a distance (N) between the secondary arms can be measured, in some cases, a cell size of the secondary arm (cell size of the dentrite, that is, DCS) is measured.

Figure 22:
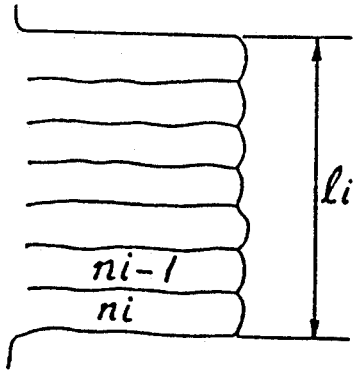
FIG. 22 is an explanatory view showing a distance between a plurality of secondary arms and how to count the number of secondary arms measured within said distance.

The measurement of the DAS of claim 20, as shown in FIG. 22, is obtained by means of a secondary branch method, in which a plurality of values are obtained by dividing a distance between a plurality of secondary arm with the number of the secondary arms included in the distance and such obtained plurality of values are expressed in an average value.

Figure 23:
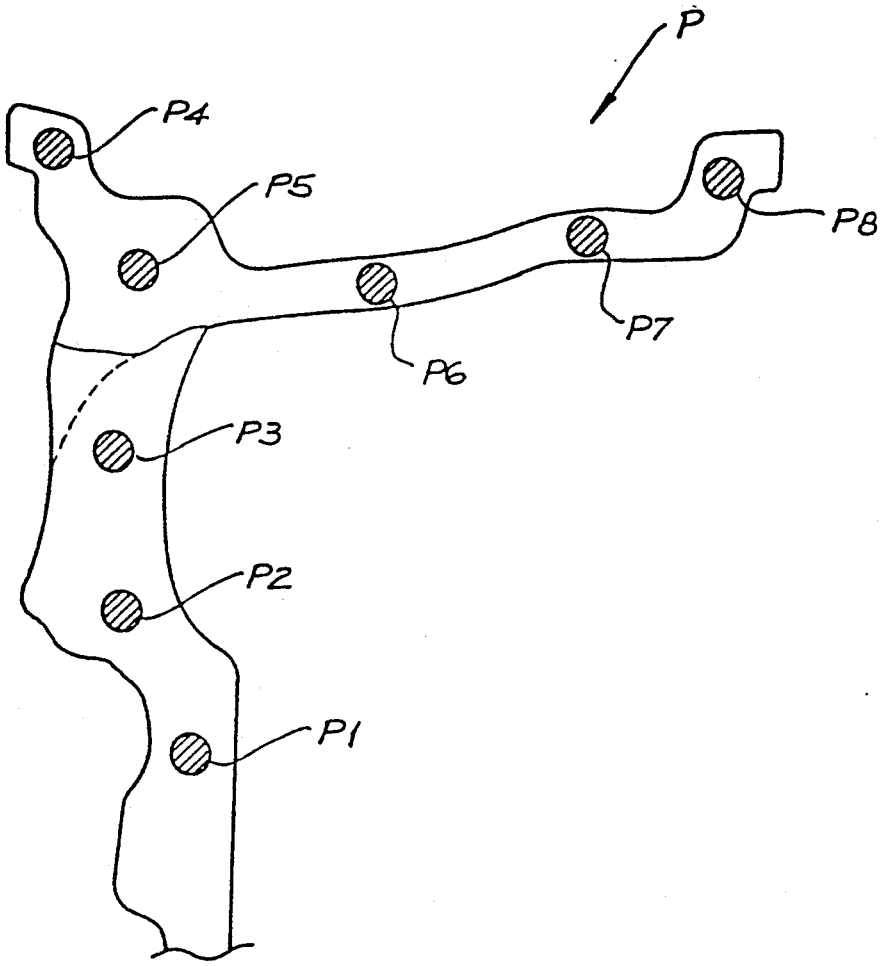
FIG. 23 is a partly omitted sectional view obtained by cutting a vehicle wheel along a plane including a rotational shaft of a wheel and showing a position for taking a sample (the remaining hair part symmetrical with respect to the rotational shaft is omitted).

FIG. 23 is a sectional view obtained by cutting a vehicle wheel P by a plane including a wheel rotational shaft. A rim barrel portion (p6) and a rim carrying portion (p3) of a disk portion are strongly acted by a deflection moment during rotation of the wheel. Therefore, this portion is required for a casting to be high in strength.

It is generally understood that the strength of a casting is high, if the crystal of the dentrite is minute.

Accordingly, this follows that one with a small measured value of DAS is high in strength. Therefore, the DAS measured values of the rim barrel portion (p6) and the rim carrying portion (p3) in the disk portion are preferably small.

The jointing portion (p5) between the rim portion and the disk portion necessarily become large in thickness in view of casting, and therefore, and cooling of the hot melt is delayed. As a result, the crystal of the dentrite becomes somewhat coarse. However, the crystal is preferably small as much as possible.

The following is a summary of preferable conditions in view of behavior of such wheel.

① The Measured value of DAS of the rim end portion at the side of the opposite disk of the wheel is smaller than the MEAsured value of DAS of the rim barrel portion.

② The Measured value of DAS of the rim carrying portion of the disk portion is smaller than the measured valve of DAS of the central portion of the disk.

③ The measured value of DAS of the rim carrying portion of the disk portion is equal to the DAS value of the rim barrel portion or smaller than the measured value of DAS of the rim barrel portion.

One which satisfies the above conditions is preferable. A vehicle wheel having such value is high in strength at its required portion.

The DAS measured values in the vehicle wheel were as shown in Table 1.

Sample No. 1-1a-1 is the measured value of DAS of the central portion of the disk of the wheel and is the measured value of the first one corresponding to a portion of the weir front according to the casting bill.

Sample No. 1-1a-2 is the measured value of DAS of an intermediate portion (p2) of the disk of the wheel and is the measured value of the first one corresponding to a portion of the weir front according to the casting bill.

Sample No. 1-1a-3 is the measured value of DAS of the rim carrying portion (p3) of the disk portion of the wheel and is the measured value of the first one corresponding to the front weir according to the casting bill.

Sample No. 1-1a-4 is the measured value of DAS of the rim end portion (p4) of the disk side at the rim portion of the wheel and is the measured value of the first one corresponding to a portion of the weir front according to the casting bill.

Sample No. 1-1a-5 is the measured value of DAS of the jointed portion (p5) between the disk portion and the rim portion of the wheel and is the measured value of the first one corresponding to a portion of the weir front according to the casting bill.

Sample No. 1-1a-6 is the measured value of DAS of the rim barrel portion (p6) of the wheel and is the measured value of the first one corresponding to a portion of the weir front according to the casting bill.

Sample No. 1-1a-7 is the measured value of DAS of a portion (p7) of an intermediate position between the rim barrel portion and the rim end portion of the opposite disk side at the rim portion of the wheel and is the measured value of the first one corresponding to a portion of the weir front according to the casting bill.

Sample No. 1-1a-8 is the measured value of DAS of the rim end portion (p8) of the opposite disk side of the wheel and is the measured value of the second one corresponding to a portion of the weir front according to the casting bill.

In the same manner, the sample number "1" in the first position represents a sample of the vehicle wheel of the present invention, the sample number "1" in the middle position represents one corresponding to a portion of the weir front according to the casting bill and likewise "2" represents one corresponding to a portion rotated at 90° from the weir front according to the casting bill, and the sample numbers "1" in the last position represents one of the central portion (p1) of the disk, likewise "2" represents one of the middle portion (p2) of the disk, "3" represents the rim carrying portion (p3) of the disk portion of the wheel, "4" represents the rim end portion (p4) of the disk side at the rim portion nearest from the disk portion, "5" represents the jointed portion (p5) between the disk portion and the rim portion, "7" represents the rim barrel portion (p6), "7" represents the portion of the intermediate position between the rim barrel portion and the rim end portion, and "8" represents the rim end portion (p8) of the opposite disk side, and the characters "a" and "b" in the middle position respectively represent the first and second ones of samples collected from the same position of a plurality of vehicle wheels of the present invention.

Also, the number "2" in the first position represents the conventional vehicle wheel according to a low pressure casting method as a comparison example and similarly, "3" represents the conventional vehicle wheel according to a gravity casting method as a comparison example.

And, the shock test results and the rotary bending test results of the sample vehicle wheels picked up from a vehicle wheel group which has such measured values were excellent compared with those of the comparison examples of the conventional vehicle wheels.

Accordingly, a vehicle wheel of the present invention not only satisfies the safety standard but also ensures uniformity with high performance.

As described in the foregoing, according to the present invention, there can be provided a vehicle wheel in which there can be estimated a performance behavior for each part which was unable to make clear by a macrotest observation as a whole wheel such as a shock test or a rotary bending test of a wheel. Therefore, the present invention greatly contributes to the development of industry.

TABLE 1

| sample No. | DAS measured values | sample No. | DAS measured values | sample No. | DAS measured values |
|---|---|---|---|---|---|
| 1-1a-8 | 26 μm | 1-1b-8 | 24 μm | 1-2a-8 | 26 μm |
| 1-1a-7 | 29 μm | 1-1b-7 | 30 μm | 1-2a-7 | 29 μm |
| 1-1a-8 | 34 μm | 1-1b-6 | 32 μm | 1-2a-6 | 29 μm |
| 1-1a-5 | 36 μm | 1-1b-5 | 30 μm | 1-2a-5 | 30 μm |
| 1-1a-4 | 26 μm | 1-1b-4 | 25 μm | 1-2a-4 | 24 μm |
| 1-1a-3 | 26 μm | 1-1b-3 | 25 μm | 1-2a-3 | 29 μm |
| 1-1a-2 | 33 μm | 1-1b-2 | 33 μm | 1-2a-2 | 35 μm |
| 1-1a-1 | 38 μm | 1-1b-1 | 33 μm | 1-2a-1 | 35 μm |
| 1-2b-8 | 25 μm | 2-1-8 | 23 μm | 3-1-8 | 46 μm |
| 1-2b-7 | 27 μm | 2-1-7 | 28 μm | 3-1-7 | 42 μm |
| 1-2b-8 | 29 μm | 2-1-6 | 29 μm | 3-1-6 | 33 μm |
| 1-2b-5 | 29 μm | 2-1-5 | 35 μm | 3-1-5 | 30 μm |
| 1-2b-4 | 22 μm | 2-1-4 | 22 μm | 3-1-4 | 20 μm |
| 1-2b-3 | 27 μm | 2-1-3 | 37 μm | 3-1-3 | 30 μm |
| 1-2b-2 | 30 μm | 2-1-2 | 40 μm | 3-1-2 | 30 μm |
| 1-2b-1 | 31 μm | 2-1-1 | 40 μm | 3-1-1 | 35 μm |

What is claimed is:

1. A method for casting in a casting space a vehicle wheel having a central disk portion, a spoke portion and a rim portion, said rim portion being substantially vertical in orientation during casting, and said rim portion having an outer peripheral portion, comprising the steps of:

partially and separately forcefully cooling said disk portion of said casting space when the vehicle wheel is cast and cooled, providing a gate into said casting space for molten metal input at the outer peripheral portion of the rim portion of said wheel casting space, providing a molten metal storage furnace disposed under said casting space, a pipe being in fluid communication with said furnace and said gate, and flowing molten metal from said furnace to said disk portion solely via said gate pipe and said and through the outer peripheral rim portion of said casting space.

2. A method of pour casting using a mold for forming a vehicle wheel having a central disk, said mold having a main body with a casting space including a portion contoured to mold said disk, said casting space having a gate for entrance of melt and a vent hole entering the casting space of said main body from above, comprising the steps of:

(a) pouring melt into said casting space with said vent hole open for venting gasses from said casting space as melt rises in said space;

(b) terminating pouring of said melt before said melt reaches said vent hole;

(c) blocking discharge through said vent hole of gasses from said casting space;

(d) applying pressurized gas to said casting space at said disk forming portion through said vent hole to pressurize said melt from above.

3. A casting device comprising:

a lower mold, an intermediate mold, a horizontal mold, and an upper mold being disposed to form a casting space therebetween, said intermediate mold including a nest extending upward into said casting space;

a plurality of annular holding members, each member having a central opening, said annular casting members being stacked on one another and being disposed within an insertion hole of said upper mold with a gap between said annular members and said insertion hole of said upper mold, said central openings being in substantial alignment and forming a surface of said casting space, said surface partially defining the shape of a product produced in said casting device;

a disk-shaped holding member being disposed on the upper one of said stacked annular members, at least one gas vent being disposed in said disk-shaped holding member.

4. A casting mold made of metal including a casting space for forming a vehicle wheel, said space having a disk portion, a spoke portion and a rim portion, said rim portion being substantially vertical in orientation when casting a wheel, comprising:

a molten metal storage furnace disposed under said casting mold, a gate connected to said rim portion of said casting space at the outer peripheral surface of said rim, a pipe being in fluid communication with said furnace and said gate to force feed molten metal from said furnace to said gate and to said casting space at the outer peripheral surface of said rim portion, a flow path for molten metal being provided from said gate to said disk portion via said rim and spoke portions, whereby said disk portion is filled with molten metal.

5. In a casting mold as in claim 4 for producing a vehicle wheel, said mold having a main body further comprising:

localized cooling means disposed in the vicinity of said gate in said main body for providing cooling at said gate to control hardening of a portion cast at said gate relative to hardening of a portion cast at other portions of said casting space.

6. A casting mold as in claim 4 for forming a vehicle wheel, further comprising:

a main body having a casting space therein including a portion contoured to mold said disk portion said casting space having a venting hole in said body communicating with said casting space from above said disk portion of said casting space;

a first valve connected to said casting space via said venting hole;

a second valve connected to said casting space via said venting hole;

said first valve communicating with the ambient environment and said second valve being for connection to a source of compressed gas, said compressed gas, when entering said casting space from above said disk portion during molding, being able to pressurize the top surface of said molten metal entering said casting space, whereby the entire casting space is filled with melt without heating said disk portion of said casting space to facilitate flow.

7. A pour casting mold as in claim 6 and further comprising an auxiliary space located above said casting space and communicating with said casting space, said second valve for connection to said pressurized gas source being connected to said auxiliary space and there through communicating with said casting space.

8. A pour casting mold as in claim 6, wherein said casting space includes a mark-forming portion on an upper surface of said casting space, said auxiliary space having a border with said casting space at a location adjacent to said mark-forming portion.

9. A casting mold including a casting space for forming a vehicle wheel, said space having a disk portion, a spoke portion and a rim portion, as in claim 4, wherein a plurality of said gates are disposed to open up in said rim portion of said casting space.

10. A casting mold as in claim 4 further comprising:

a plurality of molds, each mold having said casting space including a disk portion, a spoke portion and a rim portion, said molds being positioned horizontally relative to each other;

a plurality of gates connecting said furnace to each said casting space, said gates connecting to said casting spaces at positions corresponding to an outer peripheral surfaces at a central rim portions, said at least one melt pipe feeding at least two said molds; and cooling means for cooling said disk portions during casting.

11. A casting device as in claim 10, wherein said molds include respective gates, the gates of adjacent molds being connected with each other, said connected gates being connected to said furnace.

12. A casting mold as in claim 4 for a vehicle wheel, further comprising:

a first mold for forming an outer side;

a second mold for forming a reverse side;

a third mold for forming an outer peripheral rim surface, said casting space for a rim and a central portion being partially defined by said three molds, said third mold including at least one hot melt passage opening at one end into said casting space where, in using said casting device, said rim is cast, and at the other end opening in an outer peripheral surface of said third mold for inflow of hot metal to said third mold;

changeable means having a hot melt passage for connection to said third mold with the melt passages of said third mold and said changeable means forming a continuous passage for flow of melt said continuous passage extending, in use, from an inlet located at a source of melt to said outlet into said casting space, different contours for said continuous melt passage being provided by changing said changeable means, the inlet for melt to said continuous melt passage being from below.

13. A casting mold as in claim 4 for a vehicle wheel, further comprising:

a first mold for forming an outer side of said wheel, and including a central portion for at least partially forming said disk portion;

primary cooling means for coolant circulation arranged generally uniformly in said first mold for cooling said mold and melt in the process of casting wheels;

a nest connected to said first mold for forming a further portion of said disk portion;

auxiliary cooling means for coolant circulation for cooling said nest independently of said primary cooling means, cooling of said further disk portion thereby being separately controllable.

14. A casting device as in claim 13, wherein said vehicle wheel includes at least one potential bolt hole portion in a central disk portion, said auxiliary cooling means being positioned to cool the region of said casting device where said potential bolt hole portion of a vehicle wheel is to be cast.

15. A casting device for a vehicle wheel having a central portion, a rim, an outer side and a reverse side, and said rim having an outer peripheral surface comprising:

a first mold for forming said outer side;

a second mold for forming said reverse side;

a third mold for forming said outer peripheral rim surface, said casting space for said rim and central portion being partially defined by said three molds, said third mold including at least one hot melt passage opening at one end into said casting space where, in using said casting device, said rim is cast, and at the other end opening in an outer peripheral surface of said third mold for inflow of hot metal to said third mold;

changeable means having a hot melt passage for connection to said third mold with the melt passages of said third mold and said changeable means forming a continuous passage for flow of melt, said continuous passage extending, in use, from an inlet located at a source of melt to said outlet into said casting space, different contours for said continuous melt passage being provided by changing said changeable means, the inlet for melt to said continuous melt passage being from below;

said changeable means is radially outward of and interlocked from above with said second mold for forming said reverse side, further comprising support means for interlocking said changeable means and said second mold from above.

* * * * *